US011292703B2

(12) United States Patent
Ruhland et al.

(10) Patent No.: US 11,292,703 B2
(45) Date of Patent: Apr. 5, 2022

(54) TRANSFER SYSTEM

(71) Applicant: BHS Intralogistics GmbH, Mintraching (DE)

(72) Inventors: Karl Ruhland, Pfreimd (DE); Thomas Huber, Regensburg (DE)

(73) Assignee: BHS INTRALOGISTICS GMBH, Mintraching (DE)

( * ) Notice: Subject to any disclaimer, the term of this patent is extended or adjusted under 35 U.S.C. 154(b) by 20 days.

(21) Appl. No.: 16/783,411

(22) Filed: Feb. 6, 2020

(65) Prior Publication Data

US 2020/0255273 A1 Aug. 13, 2020

(30) Foreign Application Priority Data

Feb. 7, 2019 (DE) ..... 10 2019 201 595.6

(51) Int. Cl.
*B66F 9/18* (2006.01)
*B66F 9/075* (2006.01)
*B66F 17/00* (2006.01)

(52) U.S. Cl.
CPC ..... *B66F 9/184* (2013.01); *B66F 9/0755* (2013.01); *B66F 17/003* (2013.01)

(58) Field of Classification Search
CPC ..... B66F 9/184; B66F 9/075; B66F 17/003
See application file for complete search history.

(56) References Cited

U.S. PATENT DOCUMENTS

| | | | | |
|---|---|---|---|---|
| 4,863,335 | A | 9/1989 | Herigstad et al. | |
| 4,927,091 | A * | 5/1990 | Weiss | B65H 18/26 242/534 |
| 4,948,060 | A | 8/1990 | Kurz et al. | |
| 5,009,563 | A * | 4/1991 | Case | B65H 19/126 298/17.6 |
| 5,192,033 | A * | 3/1993 | Pipes | B65H 19/126 242/559.1 |
| 5,308,217 | A * | 5/1994 | Pienta | B21C 47/24 242/533 |
| 5,487,638 | A * | 1/1996 | Salsburg | B65H 19/123 414/796.9 |
| 5,562,394 | A * | 10/1996 | Brown, Jr. | B66C 1/66 414/626 |
| 5,934,604 | A * | 8/1999 | Klimek | B65H 16/103 242/559.4 |
| 6,264,417 | B1 | 7/2001 | Salsburg | |
| 2012/0236141 | A1 | 9/2012 | Takagawa et al. | |

FOREIGN PATENT DOCUMENTS

| | | | |
|---|---|---|---|
| DE | 4416213 | A1 | 11/1995 |
| DE | 102005032600 | A1 | 1/2007 |
| DE | 102010031650 | A1 | 1/2012 |
| GB | 2195322 | A | 4/1988 |

* cited by examiner

*Primary Examiner* — Kaitlin S Joerger
(74) *Attorney, Agent, or Firm* — McGlew and Tuttle, P.C.

(57) ABSTRACT

The invention relates to a transfer system for transferring an item with a transfer assembly for transferring an item to a transporting carriage in a transfer area and with a transporting carriage for receiving the item from the transfer assembly in the transfer area.

16 Claims, 18 Drawing Sheets

TRANSFER SYSTEM

CROSS-REFERENCES TO RELATED APPLICATIONS

This application claims the priority of German Patent Application, Serial No. DE 10 2019 201 595.6, filed Feb. 7, 2019, pursuant to 35 U.S.C. 119(a)-(d), the content of which is incorporated herein by reference in its entirety as if fully set forth herein.

FIELD OF THE INVENTION

The invention relates to a transfer system for transferring an item, such as a single piece, in particular a material roll. The invention is also directed to an overall installation with a least one such transfer system and with a corrugator. The invention is also directed to an item transfer method for transferring an item, in particular a material roll.

BACKGROUND OF THE INVENTION

It is already known from the prior art to transfer items, in particular material rolls, for further processing or for further transport. This generally takes place by hand.

SUMMARY OF THE INVENTION

The invention is based on an object of providing a transfer system for transferring an item that has a particularly long service life. Furthermore, it is intended to be particularly functionally reliable. A corresponding overall installation and a corresponding item transfer method are likewise intended to be provided.

This object is achieved according to the invention by a transfer system for transferring an item, in particular a material roll, with a transfer assembly for transferring an item to a transporting carriage in a transfer area, and with a transporting carriage for receiving the item from the transfer assembly in the transfer area.

This object is further achieved by an overall installation with at least one transfer system according to the invention and with a corrugator plant.

This object is further achieved by an item transfer method for transferring an item, in particular a material roll, comprising the steps of transferring an item to a transporting carriage in a transfer area from a transfer assembly, and receiving the item transported by the transfer assembly in the transfer area by the transporting carriage.

The essence of the invention is an, in particular automated or driverless, in particular completely automated or driverless, transfer assembly and an, in particular automated or driverless, in particular completely automated or driverless, transporting carriage, which receives the item from the transfer assembly in the transfer area. The transfer assembly thereby relinquishes the item. Both the transfer assembly and the transporting carriage are preferably operated independently. They are capable of transporting the item. The transfer system preferably operates in a completely automated manner. The actual transfer is preferably also performed in a completely automated manner. No personnel are required.

Alternatively, the transfer assembly and/or the transporting carriage are controllable manually or by hand.

The refinement, in which the transfer system comprises a transporting carriage load-relieving device, which is arranged in the transfer area and is intended for relieving the transporting carriage upon receiving the item to be transferred, prevents mechanical overloading and consequently damaging of the transporting carriage during the transfer of the item.

The raising device, comprised by the transporting carriage load-relieving device, for raising the transporting carriage, in particular from below, upon receiving the item to be transferred, is favourably arranged in a floor or underlying surface, so that, when it is not in use, it is not externally visible. When it is not in use, a surface of the raising device is favourably flush with the adjacent floor or underlying surface. The raising device comprises for example at least one spindle, hydraulic and/or pneumatic system or the like.

The refinement, in which, when it is being used, the raising device engages an item receptacle of the transporting carriage, leads to particularly good protection of the transporting carriage. An unsmooth transfer of the item therefore does not lead to the transporting carriage being damaged. Peak loads can thus be reduced. A direct introduction of force through the item receptacle into the raising device during reception of the item means that other components of the transporting carriage remain substantially free of loading. Preferably, only the item receptacle is of a sufficiently stable or load-bearing design, which is advantageous for reasons of cost.

The compensation spring unit, comprised by the raising device, having a compensation spring unit to compensate for a peak load, is designed for example as a mechanical spring, such as a helical spring or cup spring, pneumatic spring or hydraulic spring.

The aligning assembly for aligning the transporting carriage to the item transferred from the transfer assembly in the transfer area allows an, in particular axially parallel, alignment of the transporting carriage before the transfer of the item to the item. In particular, an axially parallel transfer of the item to the transporting carriage is thus possible. Thus, instances of damage, in particular to the transporting carriage or the item, are avoidable. It is expedient if the aligning assembly measures the item to be transferred before the transfer. Favourably, its axial length and/or width or diameter is measured. The transporting carriage is then appropriately aligned, such as deflected or displaced.

The refinement relating to the transfer system, in which the aligning arrangement comprises an item orientation sensing device for sensing an orientation of the item transferred from the transfer assembly into the transfer area, also allows an exact alignment of the transporting carriage to the item to be transferred. The refinements relating to the transfer system, in which an aligning assembly for aligning the transporting carriage to the item transferred from the transfer assembly in the transfer area, apply here substantially analogously. Inclined positions of the item in relation to the transporting carriage can be reliably detectable here.

The transfer station for axial alignment of the item transferred from the transfer assembly to the transporting carriage also allows an alignment of the transporting carriage before the transfer of the item to the item. Thus, instances of damage, in particular to the transporting carriage and the item, are avoidable.

In the transfer area, a possible inclined position of the item is preferably detected directly before the transfer to the transporting carriage and is transmitted to the, in particular central, computing unit. In particular, the transporting carriage or its item receptacle is aligned (axially) parallel to the item in accordance with a determined value. It is expedient if the raising device is only activated after alignment has been performed.

The at least one protective element at least partially delimiting the transfer area is designed for example as a light barrier or light grid. It prevents persons from being put at risk. The transfer assembly and/or the transporting carriage is favourably stopped if the protective element detects a person in the transfer area.

The items are favourably designed as material rolls, in particular paper rolls or cardboard rolls, and can be used in a corrugator for forming corrugated board. Alternatively, the items are for example pallets or are arranged on pallets.

The items or material rolls may differ from one another, for example in their transverse dimension or diameter, axial extent, material or the like. The transverse dimension or the diameter of the items or material rolls in the store preferably lies between 30 cm and 250 cm, with preference between 100 cm and 200 cm. The axial extent favourably lies between 60 cm and 350 cm.

It is expedient if a transfer assembly and a transporting carriage have in each case a communication device of their own, with a receiving unit for receiving external items of information or signals, which are for example items of information relating to their travel, destination and/or environment.

The transfer assembly and the transporting carriage favourably have in each case at least one displacement drive of their own for the, in particular direct or indirect, driving of at least one driveable running unit of the same. The transfer assembly and the transporting carriage are preferably independently activatable. They are in particular self-driving. The transfer assembly and/or the transporting carriage preferably travels without rails.

It is expedient if the transfer assembly and the transporting carriage comprise in each case an energy storage unit of their own, which is for example designed as a battery or storage battery. The transfer assembly and the transporting carriage are preferably steerable. It is preferred that they are capable of being driven straight ahead or in a curved manner.

The indefinite articles used in the claims do not represent a limitation in terms of quantity. For example, it is preferred that there are a multiplicity of transfer assemblies and transporting carriages.

A preferred embodiment of the invention is described below by way of example with reference to the appended drawing.

DESCRIPTION OF THE PREFERRED EMBODIMENT

Figure 1:
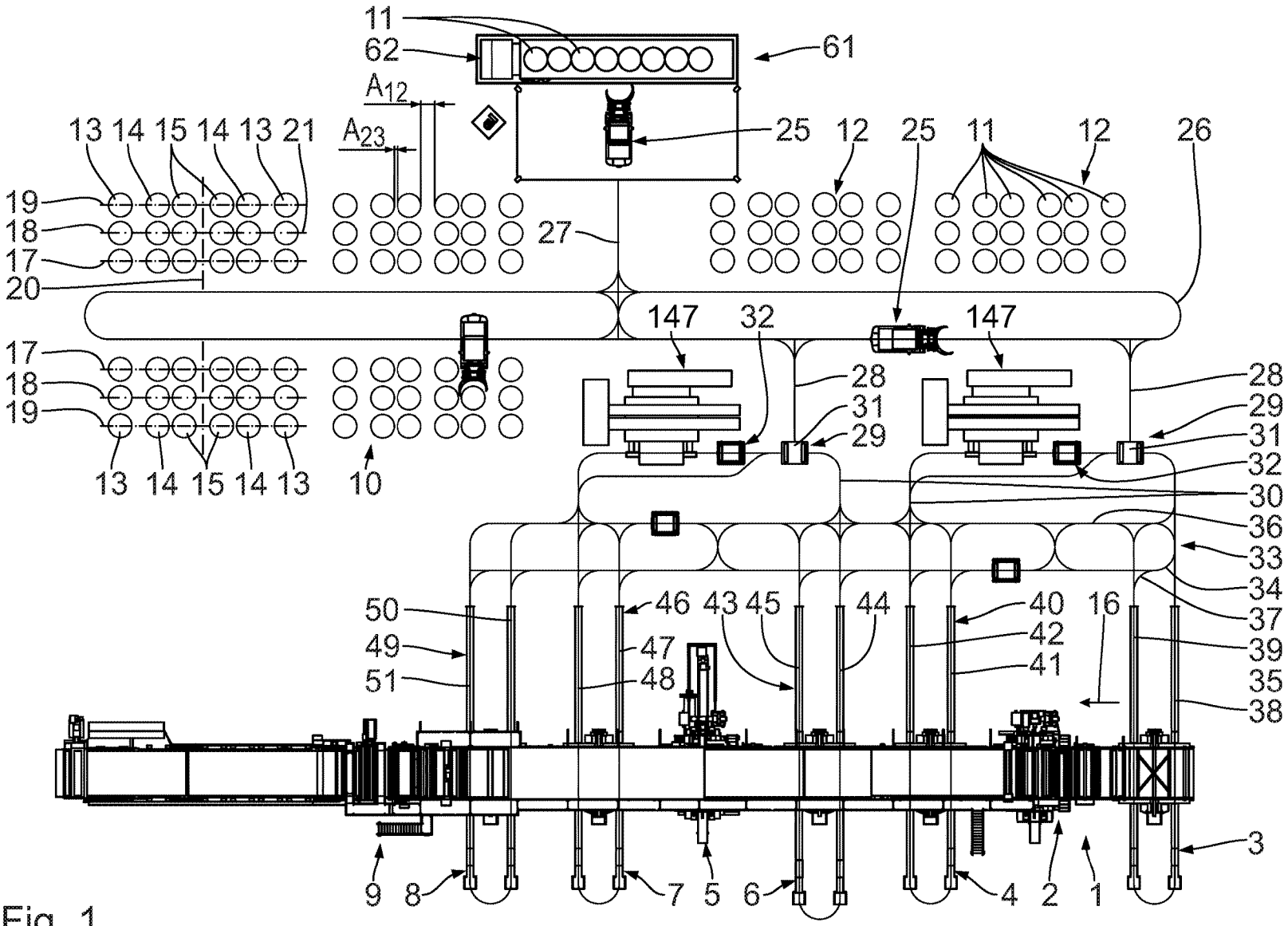
FIG. 1 shows a simplified plan view of an overall installation according to the invention.

An overall installation shown in FIG. 1 comprises a corrugator 1, which according to this preferred embodiment extends substantially in a straight line.

The corrugator 1 has a first corrugated-board production device 2 for producing a first corrugated board web which is laminated on one side.

The first corrugated-board production device 2 is preceded by a first outer liner splicing device 3 and a first inner liner splicing device 4. The first outer liner splicing device 3 comprises a first unrolling unit for unrolling a finite first outer liner from a first outer liner roll and a second unrolling unit for unrolling a finite second outer liner from a second outer liner roll. To provide an endless first outer liner, the finite first outer liner and second outer liner are connected to one another by means of a connecting and cutting unit of the first outer liner splicing device 3.

The first inner liner splicing device 4 is formed in a way corresponding to the first outer liner splicing device 3. It comprises a third unrolling unit for unrolling a finite first inner liner from a first inner liner roll and a fourth unrolling unit for unrolling a finite second inner liner from a second inner liner roll. To provide an endless first inner liner, the finite first inner liner and second inner liner are connected to one another by means of a connecting and cutting unit of the first inner liner splicing device 4.

The endless first outer liner and the endless first inner liner are fed to the first corrugated-board production device 2.

The first corrugated-board production device 2 comprises a first fluted roller assembly, with a first fluted roller and a second fluted roller, for producing an endless first corrugated board web, having a corrugation, from the endless first inner liner. The fluted rollers form a first roller gap for leading through and fluting the endless first inner liner.

For connecting the endless first outer liner to the endless corrugated first inner liner or corrugated web to form the endless first corrugated board web which is laminated on one side, the first corrugated-board production device 2 has a first glue application device, which preferably comprises a glue metering roller, a glue container and a glue application roller. For leading through and gluing the endless first corrugated web, the glue application roller forms a gap with the first fluted roller. The glue that is in the glue container is applied by way of the glue application roller to tips of the corrugation of the endless first corrugated web. The glue metering roller lies against the glue application roller and serves for forming a uniform layer of glue on the glue application roller.

The endless first outer liner is subsequently joined together with the endless first corrugated web, provided with glue from the glue container, in the first corrugated-board production device 2 to produce the first corrugated board web which is laminated on one side.

For pressing the endless first outer liner against the endless first corrugated web, provided with glue, which in turn lies in certain regions against the first fluted roller, the first corrugated-board production device 2 has a first pressing module. The first pressing module is favourably designed as a pressing band module. It is arranged above the first fluted roller. The first pressing module has two first deflecting rollers and also an endless first pressing band, which is led around the two first deflecting rollers.

The first fluted roller reaches into a space between the two first deflecting rollers of the first pressing module in certain regions from below, whereby the first pressing band is deflected by the first fluted roller. The first pressing band presses against the endless first outer liner, which in turn is pressed against the endless first corrugated web, provided with glue, lying against the first fluted roller.

For intermediately storing and buffering the endless first corrugated board web which is laminated on one side, it is fed by way of a first vertical transporting device to a first storage device, where the latter forms loops.

The corrugator 1 also has a second corrugated-board production device 5, which is formed in a way corresponding to the first corrugated-board production device 2.

The second corrugated-board production device 5 is preceded by a second outer liner splicing device 6 and a second inner liner splicing device 7, which are formed in a way corresponding to the first outer liner splicing device 3 and the first inner liner splicing device 4.

The second outer liner splicing device 6 comprises a fifth unrolling unit for unrolling a finite third outer liner from a third outer liner roll and a sixth unrolling unit for unrolling a finite fourth outer liner from a fourth outer liner roll. To provide an endless second outer liner, the finite third outer liner and the fourth outer liner are connected to one another by means of a connecting and cutting unit of the second outer liner splicing device 6.

The second inner liner splicing device 7 comprises a seventh unrolling unit for unrolling a finite third inner liner from a third inner liner roll and an eighth unrolling unit for unrolling a finite fourth inner liner from a fourth inner liner roll. To provide an endless second inner liner, the finite third inner liner and the fourth inner liner are connected to one another by means of a connecting and cutting unit of the second inner liner splicing device 7.

The second corrugated-board production device 5 is capable of producing an endless, second corrugated board web which is laminated on one side from the endless second outer liner and inner liner.

The second corrugated board web which is laminated on one side is fed to a second storage device, where the latter forms loops.

The corrugator 1 also has a laminating web splicing device 8, which comprises a ninth unrolling unit for unrolling a finite first laminating web from a first laminating web roll and a tenth unrolling unit for unrolling a finite second laminating web from a second laminating web roll. To provide an endless laminating web, the finite first laminating web and the finite second laminating web are connected to one another by means of a connecting and cutting unit of the laminating web splicing device 8.

Downstream of the storage devices and the laminating web splicing device 8, the corrugator 1 has a preheating device (not represented), which comprises three preheating rollers arranged one above the other. The endless corrugated board webs which are laminated on one side and the endless laminating web are fed to the preheating rollers.

Downstream of the preheating device, the corrugator 1 has a glue unit (not represented) with glueing rollers, which are partially immersed in a respective glue bath. Lying against each gluing roller is a glue metering roller, in order to form a uniform layer of glue on the adjacent glueing roller. The first corrugated board web which is laminated on one side is in contact by its corrugated web with a first glueing roller, so that the corrugation of this corrugated web is provided with glue from the glue bath. The second corrugated board web which is laminated on one side is in contact by its corrugated web with a second glueing roller, so that the corrugation of this corrugated web is provided with glue from the associated glue bath.

Downstream of the glue unit, the corrugator 1 has a connecting device 9, which is formed as a heating pressure-exerting device and comprises a horizontally running heating table. Arranged adjacent to the heating table is an endless pressure-exerting belt, which is led around guiding rollers. Formed between the pressure-exerting belt and the heating table is a pressure-exerting gap, through which the corrugated board webs which are laminated on one side and the endless laminating web are led to form an endless, here five-ply, corrugated board web.

Downstream of the connecting device 9, the corrugator 1 has a short transverse cutting device (not represented).

Downstream of the short transverse cutting device, the corrugator 1 comprises a longitudinal cutting/grooving device (not represented).

Downstream of the longitudinal cutting/grooving device, the corrugator 1 has a transverse cutting device (not represented), in order to produce sheets from the endless corrugated board web or from partial webs of the same.

The transverse cutting device is followed by a conveyor belt device (not represented), in order to convey the sheets further. The conveyor belt device is followed by a depositing device (not represented), in order to form sheet stacks.

At a distance from the corrugator 1, the overall installation has a material roll store 10, in which a multiplicity of material rolls 11 are located. The material rolls 11 can be used in the splicing devices 3, 4, 6, 7, 8. They are combined in the material roll store 10 into groups 12, which are arranged at a distance from one another. The material rolls 11 are for example arranged identically in the individual groups 12.

The material rolls 11 are arranged upright in the material roll store 10. They are thereby supported by their end faces in relation to an underlying surface or floor, which is for example a factory floor and also bears the corrugator 1.

Each group 12 has a first row 13 with material rolls 11. Adjacent to the first row 13, in each group 12 there extends a second row 14 with material rolls 11. Adjacent to the second row 14, in each group 12 there extends a third row 15 with material rolls 11. In the case of a fully stocked material roll store 10, there are preferably the same number of material rolls 11 in each row 13, 14, 15.

In the case of this preferred embodiment shown, there are three material rolls 11 per row 13, 14, 15. A different number of material rolls 11 per row 13, 14, 15 is alternatively possible. Alternatively, the number of material rolls 11 per row 13, 14, 15 differs.

The rows 13, 14, 15 with material rolls 11 run parallel to one another. They extend perpendicularly to a longitudinal or conveying direction 16 of the corrugator 1. In each row 13, 14, 15, central or longitudinal axes of the material rolls 11 arranged there are consequently in a common vertical longitudinal plane. The vertical longitudinal planes of the rows 13, 14, 15 run parallel to one another and extend perpendicularly to the corrugator 1.

The material rolls 11 arranged in the different rows 13, 14, 15 are located in different vertical transverse planes 17, 18, 19, which run parallel to one another, include the individual central or longitudinal axes of the material rolls 11 arranged in the respective row 13, 14, 15 and run perpendicularly to the longitudinal planes.

The horizontal distance from one another of the material rolls 11 arranged in a row 13, 14, 15 is identical. Alternatively, the material rolls 11 arranged in a row 13, 14, 15 are touching one another.

The material rolls 11 arranged in the first row 13 have in relation to the material rolls 11 arranged in the adjacent second row 14 a first minimum distance $A_{12}$ between maximum diameter ranges of material rolls 11 arranged adjacent to one another. The minimum distance $A_{12}$ consequently lies between outer sides or circumferential regions of material rolls 11 in the first and second rows 13, 14. A first delimiting line of the minimum distance $A_{12}$ is formed by a first tangent of the material rolls 11 arranged in the first row 13. A second delimiting line of the minimum distance $A_{12}$ is formed by a second tangent of the material rolls 11 arranged in the second row 14.

The material rolls 11 arranged in the second row 14 have in relation to the material rolls 11 arranged in the adjacent third row 15 a second minimum distance $A_{23}$ between maximum diameter ranges of material rolls 11 arranged adjacent to one another. The minimum distance $A_{23}$ consequently lies between outer sides or circumferential regions of material rolls 11 in the second and third rows 14, 15. A first delimiting line of the minimum distance $A_{23}$ is formed by a first tangent of the material rolls 11 arranged in the second row 14. A second delimiting line of the minimum distance $A_{23}$ is formed by a second tangent of the material rolls 11 arranged in the third row 15.

The minimum distances $A_{12}$ and $A_{23}$ differ significantly from one another. The minimum distance $A_{12}$ is much greater than the minimum distance $A_{23}$. According to this embodiment, the minimum distance $A_{12}$ is 87.5 cm. It preferably lies between 50 cm and 90 cm and in particular allows a person an escape route. The minimum distance $A_{23}$ preferably lies between 0 cm and 30 cm. It is favourably as small as possible, that is to say 0 cm, in order to make optimum use of the surface area of the material roll store 10. The minimum distance $A_{23}$ is therefore dependent in particular on a geometrical design of a transfer assembly for transferring the material rolls 11, its gripping device or its first gripping arm device and/or second gripping arm device. The gripping device must be capable in particular of reliably receiving the material roll(s) 11. For example, a width of a frame of the transfer assembly (overhang) must be taken into account, in order that the material roll(s) 11 to be gripped is/are reliably reachable.

The material rolls 11 of each group 12 are arranged symmetrically in relation to a first plane of symmetry 20, which extends parallel to the rows 13, 14, 15. It extends between two third rows 15, which are arranged adjacent to one another there.

Furthermore, the material rolls 11 of each group 12 are arranged symmetrically in relation to a second plane of symmetry 21, which extends perpendicularly to the first plane of symmetry 20 in the central transverse plane 18.

Figure 11:
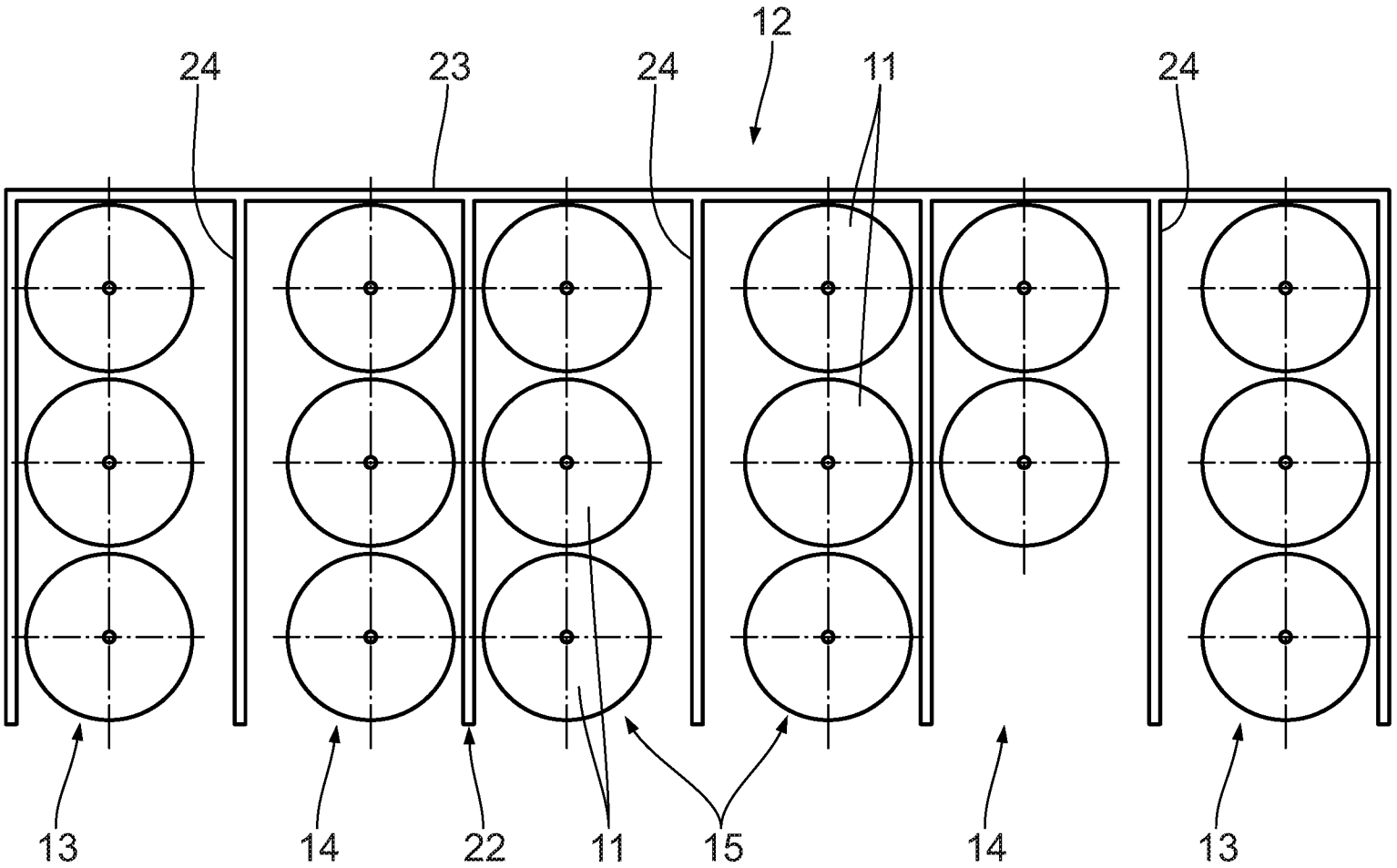
FIG. 11 shows a plan view of the material roll store shown in FIG. 10.
Figure 12:
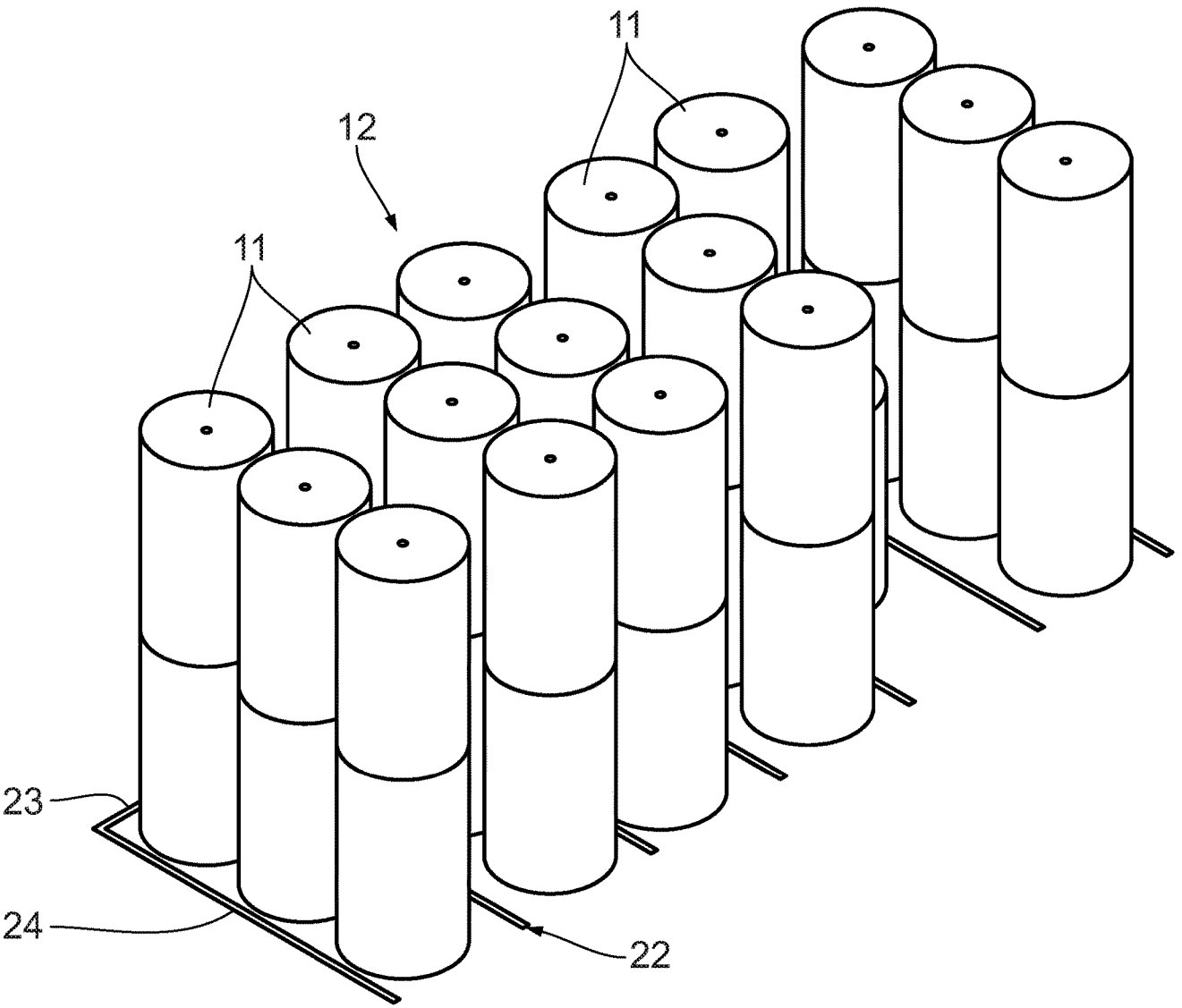
FIG. 12 shows a perspective view of the material roll store shown in FIGS. 10 and 11.

As FIGS. 11 and 12 show, each row 13, 14, 15 is arranged within a floor marking 22, which has a marking base 23 and marking dividers 24 extending out from the marking base 23. The marking bases 23 are in line with one another. The marking dividers 24 run parallel to one another and perpendicularly to the marking base 23. They have an identical length, taken from the marking base 23.

The material rolls 11 can be removed from the material roll store 10 by way of automated or driverless transfer assemblies 25 (see for example FIGS. 6 to 9).

As FIG. 1 shows, there is a closed transfer assembly circulating path 26, which extends along the opposite first transverse planes 17 of the respective groups 12. The transfer assembly circulating path 26 comprises two endless partial circulating paths arranged next to one another. It is connected to a transfer assembly main path 27, which extends perpendicularly to the longitudinal or conveying direction 16 of the corrugator 1 between individual groups 12 and runs between the partial circulating paths. Alternatively, instead of a transfer assembly circulating path 26, there is a transfer assembly path 26 that can be travelled along in opposite directions.

The transfer assembly circulating path 26 is adjoined on a side facing the corrugator 1 by two transfer assembly transverse paths 28, which extend perpendicularly to the longitudinal or conveying direction 16 of the corrugator 1. Each transfer assembly transverse path 28 is in connection with a transfer system 29 (FIG. 1).

The transfer assembly circulating path 26 and transfer assembly main path 27 as well as the transfer assembly transverse paths 28 are preferably purely theoretical and with preference are determined by way of software navigation. In the case of obstacles or oncoming traffic, a deviation is made from the paths 26, 27, 28.

The transfer systems 29 are identically designed. Each transfer system 29 has a transfer area 31, in which a material roll 11 transferred from a transfer assembly 25 can be transferred to a transporting carriage 32 for further transport of the material roll 11 to the corrugator 1 (FIG. 1).

Also represented in FIG. 1 are transporting carriage displacement path markers 33, which indicate and preset the displacement paths of the transporting carriages 32 in the corrugator 1 or adjacent to it. With preference, the transporting carriage displacement path markers 33 are visible and painted on the planar underlying surface that bears the corrugator 1. They can be detected by the transporting carriage 32. When travelling in normal operation, the transporting carriages 32 follow the transporting carriage displacement path markers 33, which comprise curves, turnouts, crossings and straight portions.

Also connected to each transfer system 29 is an allocating path 30.

Each allocating path 30 leads to a material roll preparation assembly 147 for preparing the material rolls 11 for further machining/processing. The preparation of the respective material roll 11 comprises for example unpacking or exposing the same, removing or destroying at least one fixing means that is fixing a free portion of the material web to prevent unwinding of the material roll 11, removing at least one strapping element, removing a damaged portion of the material web from the material roll 11, producing a defined end contour or edge for the further processing on the material web, attaching at least one (splicing) adhesive piece to the material web and/or fixing a portion at the end of the material web on the material roll 11.

Each material roll preparation assembly 147 comprises a receiving device for receiving a material roll 11 to be prepared, having a web of material wound up on it. The receiving device has a rotating device for rotationally driving or pivoting the received material roll 11 about its central axis or in its circumferential direction.

Each material roll preparation assembly 147 also has at least one material roll preparation device, with preference a number of material roll preparation devices, for preparing the received material roll 11 for the further machining/processing.

Each allocating path 30 is connected by way of the respective material roll preparation assembly 147 and a bypass to a distribution path 34, which is designed as a circuit. The distribution path 34 extends between the corrugator 1 and the material roll store 10. It extends parallel to the corrugator 1.

The distribution path 34 is adjoined by a first outer liner path 35. The first outer liner path 35 adjoins a first distribution path portion 36 and a second distribution path portion 37 of the distribution path 34. The first outer liner path 35 is quasi endless and comprises a first outer liner path portion 38 and a second outer liner path portion 39. The outer liner path portions 38, 39 extend parallel to one another and are in line with the unrolling units of the first outer liner splicing device 3. The outer liner path portions 38, 39 pass through the corrugator 1 at a respective unrolling unit and are connected to one another on the far side of the corrugator 1.

For loading the first outer liner splicing device 3 and removing residual material rolls, the transporting carriages 32 are displaceable in opposite directions both on the first outer liner path portion 38 and on the second outer liner path portion 39. A circulating transport of the transporting carriages 32 in one direction along the first outer liner path 35 is also possible for loading the first outer liner splicing device 3 and removing a residual material roll.

The distribution path 34 is adjoined by a first inner liner path 40. The first distribution path portion 36 and the second distribution path portion 37 are adjoined by the first inner liner path 40, which is quasi endless and comprises a first inner liner path portion 41 and a second inner liner path portion 42. The inner liner path portions 41, 42 extend parallel to one another and to the outer liner path portions 38, 39. They are in line with the unrolling units of the first inner liner splicing device 4. The first and second inner liner path portions 41, 42 pass through the corrugator 1 at the respective unrolling unit and are connected to one another on the far side of the corrugator 1.

For loading the first inner liner splicing device 4 and removing residual material rolls, the transporting carriages 32 are displaceable in opposite directions both on the first inner liner path portion 41 and on the second inner liner path portion 42. A circulating transport of the transporting carriages 32 in one direction along the first inner liner path 40 is also possible for loading the first inner liner splicing device 4 and removing a residual material roll.

The distribution path 34 is adjoined by a second outer liner path 43. The first distribution path portion 36 and the second distribution path portion 37 are adjoined by the second outer liner path 43, which is quasi endless and comprises a first outer liner path portion 44 and a second outer liner path portion 45. The outer liner path portions 44, 45 extend parallel to one another and to the outer liner path portions 38, 39. They are in line with the unrolling units of the second outer liner splicing device 6. The first and second outer liner path portions 44, 45 pass through the corrugator 1 at the respective unrolling unit and are connected to one another on the far side of the corrugator 1.

For loading the second outer liner splicing device 6 and removing residual material rolls, the transporting carriages 32 are displaceable in opposite directions both on the first outer liner path portion 44 and on the second outer liner path portion 45. A circulating transport of the transporting carriages 32 in one direction along the second outer liner path 43 is also possible for loading the second outer liner splicing device 6 and removing a residual material roll.

The distribution path 34 is adjoined by a second inner liner path 46. The first distribution path portion 36 and the second distribution path portion 37 are adjoined by the second inner liner path 46, which is quasi endless and comprises a first inner liner path portion 47 and a second inner liner path portion 48. The inner liner path portions 47, 48 extend parallel to one another and to the outer liner path portions 38, 39. They are in line with the unrolling units of the second inner liner splicing device 7. The first and second inner liner path portions 47, 48 pass through the corrugator 1 at the respective unrolling unit and are connected to one another on the far side of the corrugator 1.

For loading the second inner liner splicing device 7 and removing residual material rolls, the transporting carriages 32 are displaceable in opposite directions both on the first inner liner path portion 47 and on the second inner liner path portion 48. A circulating transport of the transporting carriages 32 in one direction along the second inner liner path 45 is also possible for loading the second inner liner splicing device 7 and removing a residual material roll.

The distribution path 34 is adjoined by a laminating web path 49. The first distribution path portion 36 and the second distribution path portion 37 are adjoined by the laminating web path 49, which is quasi endless and comprises a first laminating web path portion 50 and a second laminating web path portion 51. The laminating web path portions 50, 51 extend parallel to one another and to the outer liner path portions 38, 39. They are in line with the unrolling units of the laminating web splicing device 8. The first and second laminating web path portions 50, 51 pass through the corrugator 1 at the respective unrolling unit and are connected to one another on the far side of the corrugator 1.

For loading the laminating web splicing device 8 and removing residual material rolls, the transporting carriages 32 are displaceable in opposite directions both on the first laminating web path portion 50 and on the second laminating web path portion 51. A circulating transport of the transporting carriages 32 in one direction along the laminating web path 49 is also possible for loading the laminating web splicing device 8 and removing a residual material roll.

The outer liner parts 35, 43, the inner liner paths 40, 46 and the laminating web path 49 are connected to the distribution path 34 at a distance from one another and run at a distance from one another.

Figure 13:
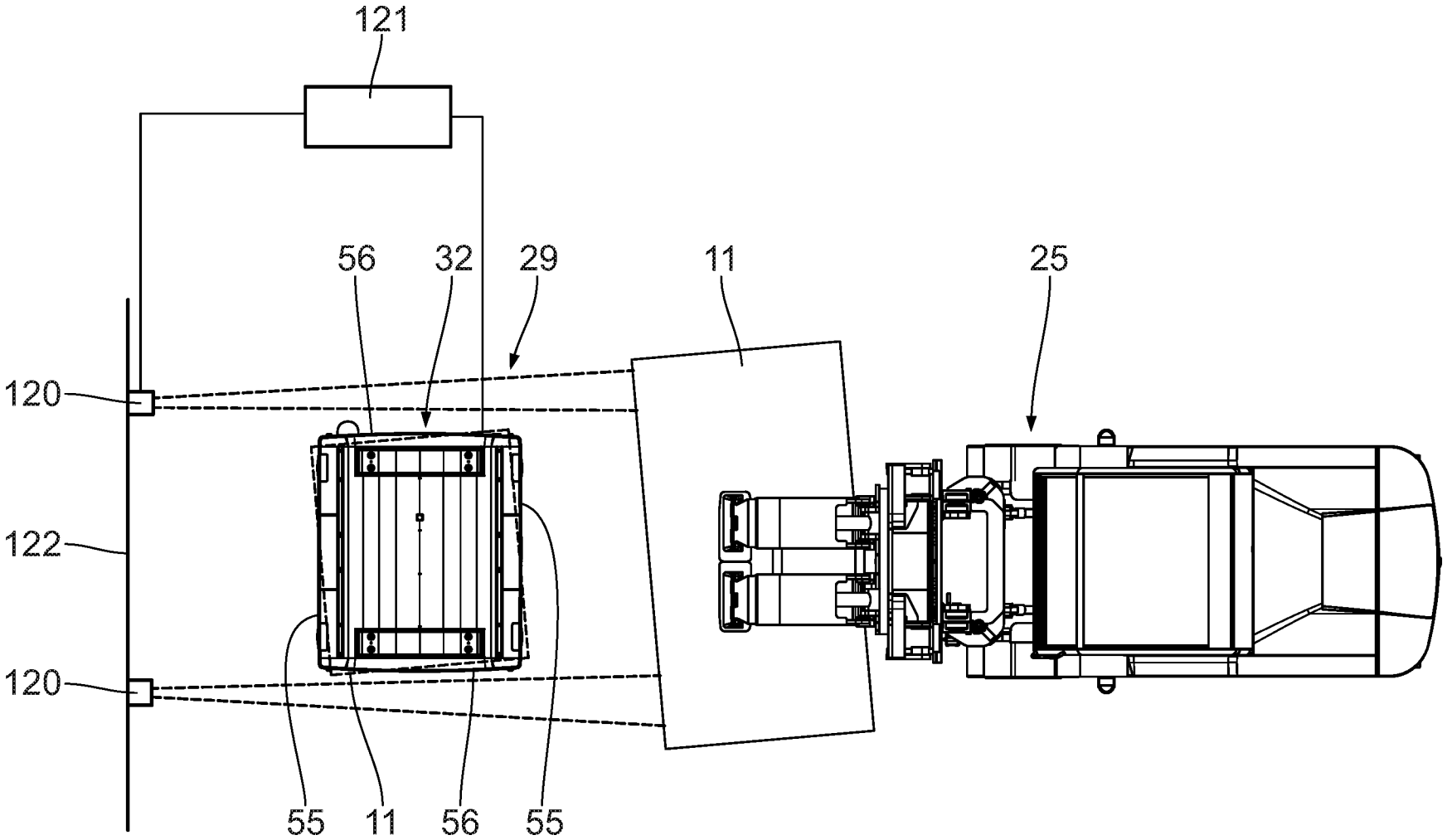
FIG. 13 shows a plan view of a transfer system according to the invention for transferring a material roll to a transfer assembly of the overall installation shown in FIG. 1.

The transporting carriages 32 are identically designed. Each transporting carriage 32 has a rigid base frame 52 in the manner of a frame or a chassis (for example FIGS. 13 to 15). The base frame 52 bears a material roll receptacle 53 for a lying material roll 11 and a number of wheel units 54 for displacing the transporting carriage 32 on the underlying surface as well as a communication device (not represented).

In dependence on signals or items of information received by way of the communication device, the transport carriage 32 can be set in motion. Correspondingly, items of information relating to their path or destination can also be transmitted to the transporting carriages 32. The transporting carriage 32 can be displaced in a straight line or in a curved manner.

The base frame 52 has two longitudinal sides 55 and two transverse sides 56. The longitudinal sides 55 run parallel to one another. They extend parallel to the material roll receptacle 53. The transverse sides 56 also extend parallel to one another. The longitudinal sides 55 and the transverse sides 56 are oriented at right angles to one another.

Arranged on the base frame 52 is an autonomous displacement drive (not represented), which comprises an electric motor.

In drive connection with each displacement drive is a driving wheel (not represented), which is mounted in a rotatable or rotatably driveable manner. The axes of rotation of the drive wheels are in line with one another. They extend perpendicularly to the longitudinal sides 55. The drive wheels are located in the middle in relation to a longitudinal direction of the transporting carriage 32. They cannot be steered and are supported in relation to the underlying surface during the displacement of the transporting carriage 32.

Also arranged at each corner region of the base frame 52 is a steering wheel unit 57, which in each case comprises a twin wheel. The twin wheels are rotatably mounted. Each steering wheel unit 57 can be independently deflected about a vertical steering axis 58. The steering wheel units 57 are freely deflectable, in particular by 360°. The steering axes 58 run parallel to one another.

The material roll receptacle 53 is formed by at least one channel part 59, which in each case is mounted vertically displaceably on the base frame 52 and is upwardly open. The at least one channel part 59 extends between the longitudinal sides 55 adjacent to the transverse sides 56. Its deepest receiving point is located midway between the longitudinal sides 55. It is symmetrically formed. The at least one channel part 59 has its highest point adjacent to the longitudinal sides 55. It is open adjacent to the transverse sides 56 of the base frame 52 or in the longitudinal direction.

The material roll receptacle 53 bears at the bottom at least one horizontally running supporting plate 60.

Also arranged on the base frame 52 is a storage battery (not represented). The storage battery is a rechargeable store for electrical energy for the displacement drives.

Arranged furthermore on the base frame 52 is a transporting carriage controller (not represented), which is capable of activating the two displacement drives independently of one another. The transporting carriage controller is also in signalling connection with the communication device.

The electronic and electrical components of the transporting carriage 32 are electrically connected to one another in a suitable way.

Arranged furthermore on the base frame 52, in a front region, is a safety device (not represented), which is designed as a scanner, in particular a laser scanner. The safety device is in signalling connection with the transporting carriage controller. It is capable of stopping the transporting carriage 32 immediately if danger is detected.

Arranged at the front on the base frame 52, adjacent to the transverse side 56 of the transporting carriage 32 that is at the front during the displacement, is a displacement path detecting device (not represented), which is designed as a sensor. The displacement path detecting device is of an elongated form and extends horizontally. It runs perpendicularly to the longitudinal direction of the transporting carriage 32. It is capable of detecting a preset displacement path and is in signalling connection with the transporting carriage controller. Alternatively, a displacement path or destination can be preset for the transporting carriage 32 by way of software.

Furthermore, the transporting carriage 32 has a material roll detecting sensor (not represented). The material roll detecting sensor is capable of detecting whether the transporting carriage 32 is laden or unladen. The material roll detecting sensor is located in the material roll receptacle 53 and is in signalling connection with the transporting carriage controller.

The transporting carriage 32 can be displaced by providing the at least one displacement drive with power. The necessary electrical energy originates from the storage battery. The displacement drives receive corresponding travel signals indirectly by way of the displacement path detecting device and/or by way of the communication device.

If the two drive wheels are driven by the same amount in opposite directions, the transporting carriage 32 turns on the spot. If one drive wheel is driven more powerfully than the other drive wheel, the transporting carriage 32 travels in a curved manner. The steering wheel units 57 thereby adjust themselves automatically about the respective steering axis 58. If the two drive wheels are driven identically and in the same direction, the transporting carriage 32 travels straight ahead. The steering wheel units 57 set themselves automatically in a way corresponding to travelling straight ahead.

The transfer assembly main path 27 begins in a delivery system 61, which comprises a semitrailer unit 62 (FIGS. 1 to 5). The semitrailer unit 62 is used to deliver new material rolls 11. The semitrailer unit 62 comprises a semitrailer tractor 63 and a semitrailer 64.

The semitrailer tractor 63 has in turn a chassis, an engine and a gearbox as well as a coupling for the semitrailer 64.

The semitrailer 64 forms a trailer and comprises rear axles 65, which are supported in relation to a floor or ground. It has a planar loading area 66 for carrying the material rolls 11. The material rolls 11 stand on the loading area 66 in at least one row along the semitrailer 64. They are arranged horizontally at a distance from one another in the longitudinal direction of the semitrailer 64. Alternatively, they are touching one another circumferentially. The semitrailer 64 also has a tarpaulin frame 67, which bears a tarpaulin 68 and spatially delimits a loading space 69. The tarpaulin 68 can be opened at the sides and preferably also at the rear, which allows access to the loading space 69. The loading space 69 is spatially delimited downwards by the loading area 66.

A stop marking 70 on the floor presets an intended stopping position for the semitrailer unit 62. The stop marking 70 comprises a longitudinal stop line 71, which presets a longitudinal intended stopping position of the semitrailer unit 62 in its longitudinal direction 72 or travelling direction. Furthermore, the stop marking 70 has two parallel transverse stop lines 73, which run at a distance from one another and preset an intended transverse stopping position perpendicularly to the longitudinal direction 72 or travelling direction of the semitrailer unit 62. The stop marking 70 preferably has a rectangular contour, which corresponds substantially to the base area of the semitrailer unit 62.

Figure 2:
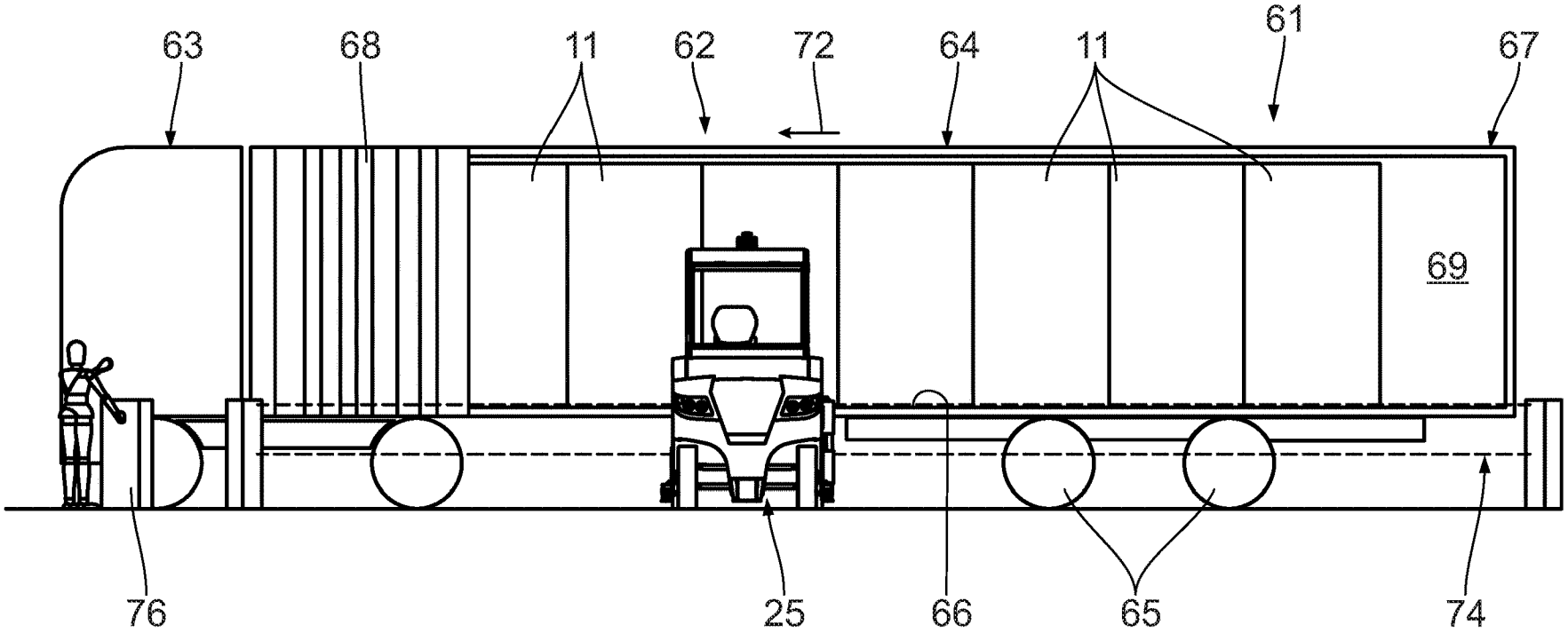
FIG. 2 shows a side view of a delivery system with a delivery vehicle and an automated transfer assembly of the overall installation shown in FIG. 1.
Figure 3:
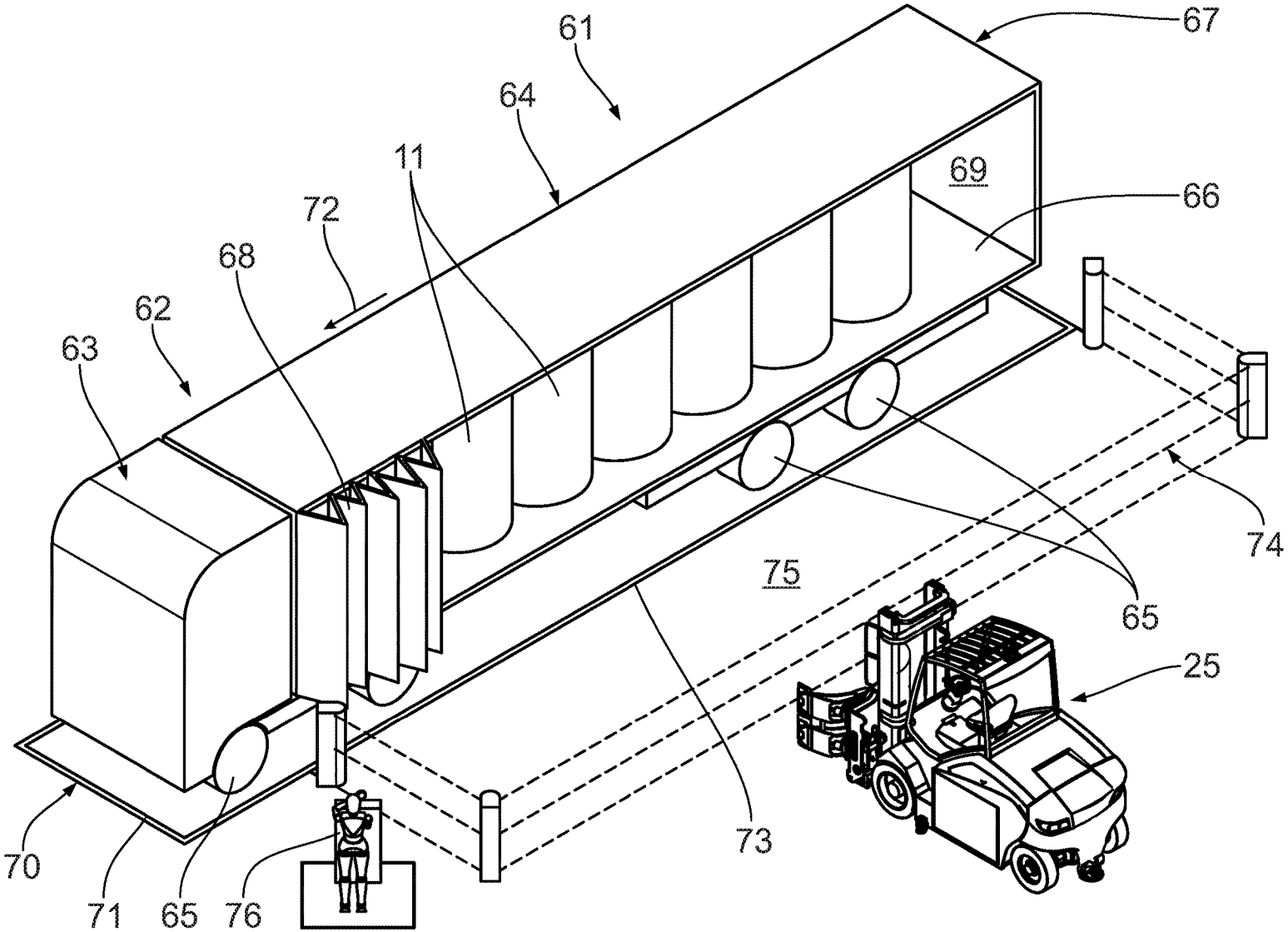
FIG. 3 shows a perspective representation of the delivery system shown in FIG. 2.
Figure 4:
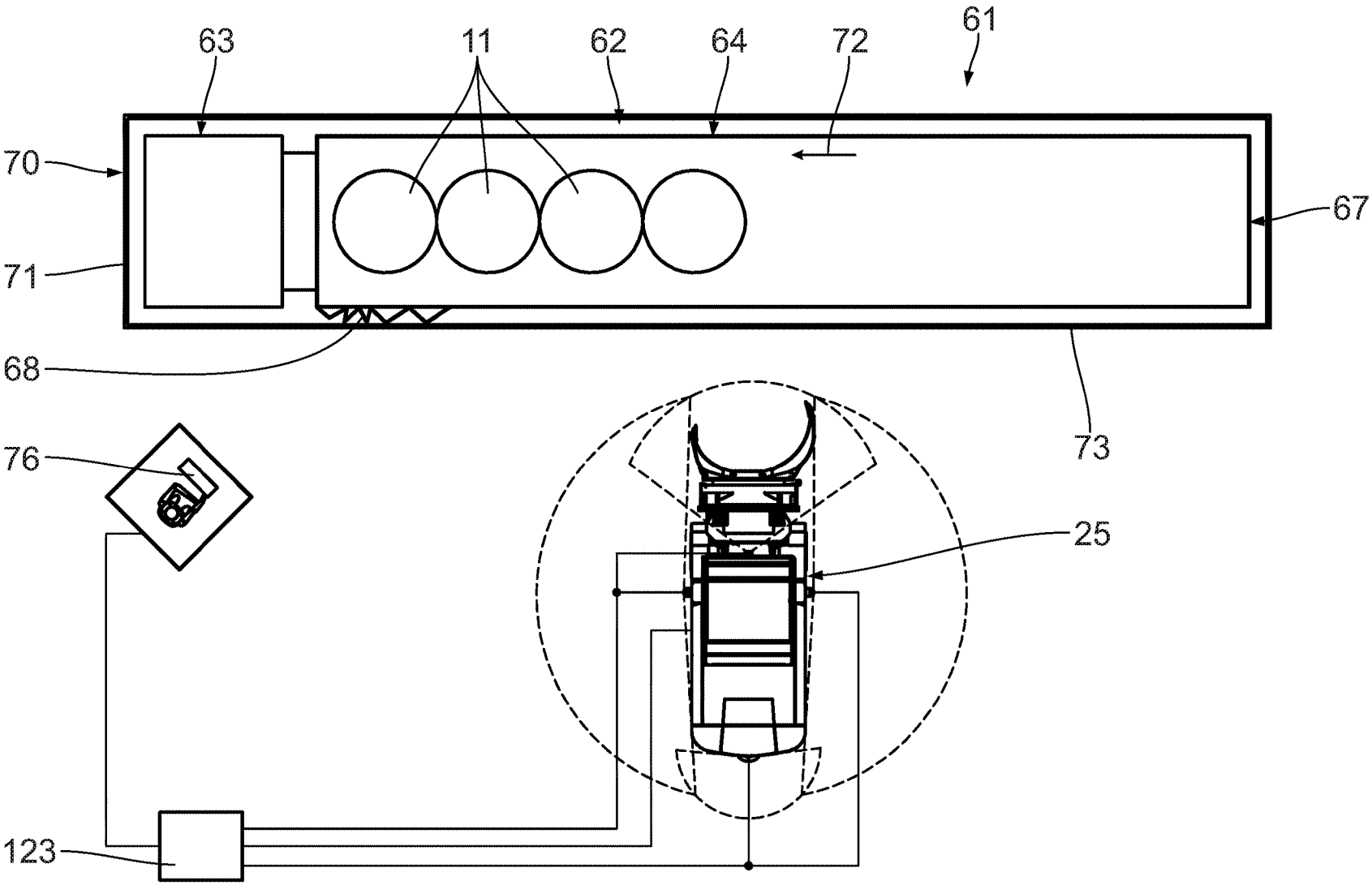
FIG. 4 shows a plan view of an alternative delivery system, in which active safety devices of the transfer assembly are also represented.

The delivery system 61 according to FIG. 2, 3, 5 also comprises a delivery or unloading safety device 74, which is designed as a safety light barrier and prevents persons from entering a delivery or unloading area 75 adjacent to the semitrailer unit 62 parked in the intended stopping position. The delivery safety device 74 can be activated by the driver of the semitrailer unit 62 or some other person using an operator terminal 76. The operator terminal 76 is then located adjacent to the semitrailer tractor 63. The driver or the other person only uses the operator terminal 76 to activate the delivery safety device 74 when the tarpaulin 68 has been removed such that the newly delivered material rolls 11 can be unloaded from the semitrailer unit 62. The transfer assembly 25 only enters the delivery area 75 when the delivery safety device 74 has been activated.

The transfer assembly 25 is formed as an automated or driverless industrial truck (FIGS. 6 to 9). The industrial truck 25 has a frame 79, which is supported on front wheels 77 and rear wheels 78 and bears a cab 80 and a front hydraulic lifting device 81. The front wheels 77 and rear wheels 78 are supported in relation to the underlying surface. The rear wheels 78 are deflectable.

The frame 79 also bears a battery or a storage battery (not represented) and at least one displacement drive (not represented) in electrical connection with it, which with preference is in drive connection with the rear wheels 78.

Figure 9:
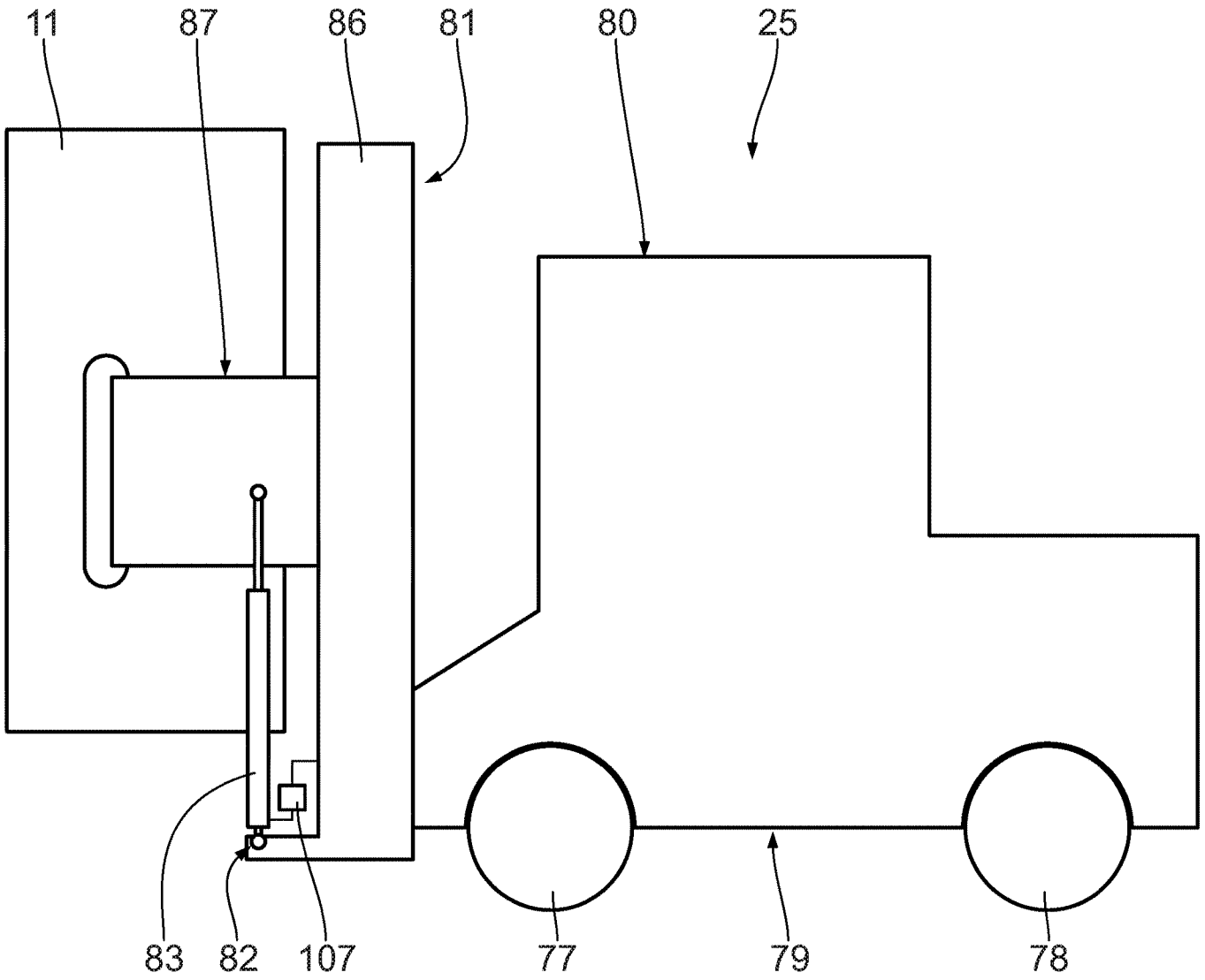
FIG. 9 shows a simplified side view of a transfer assembly according to FIGS. 7 and 8A to illustrate a lifting device.
Figure 10:
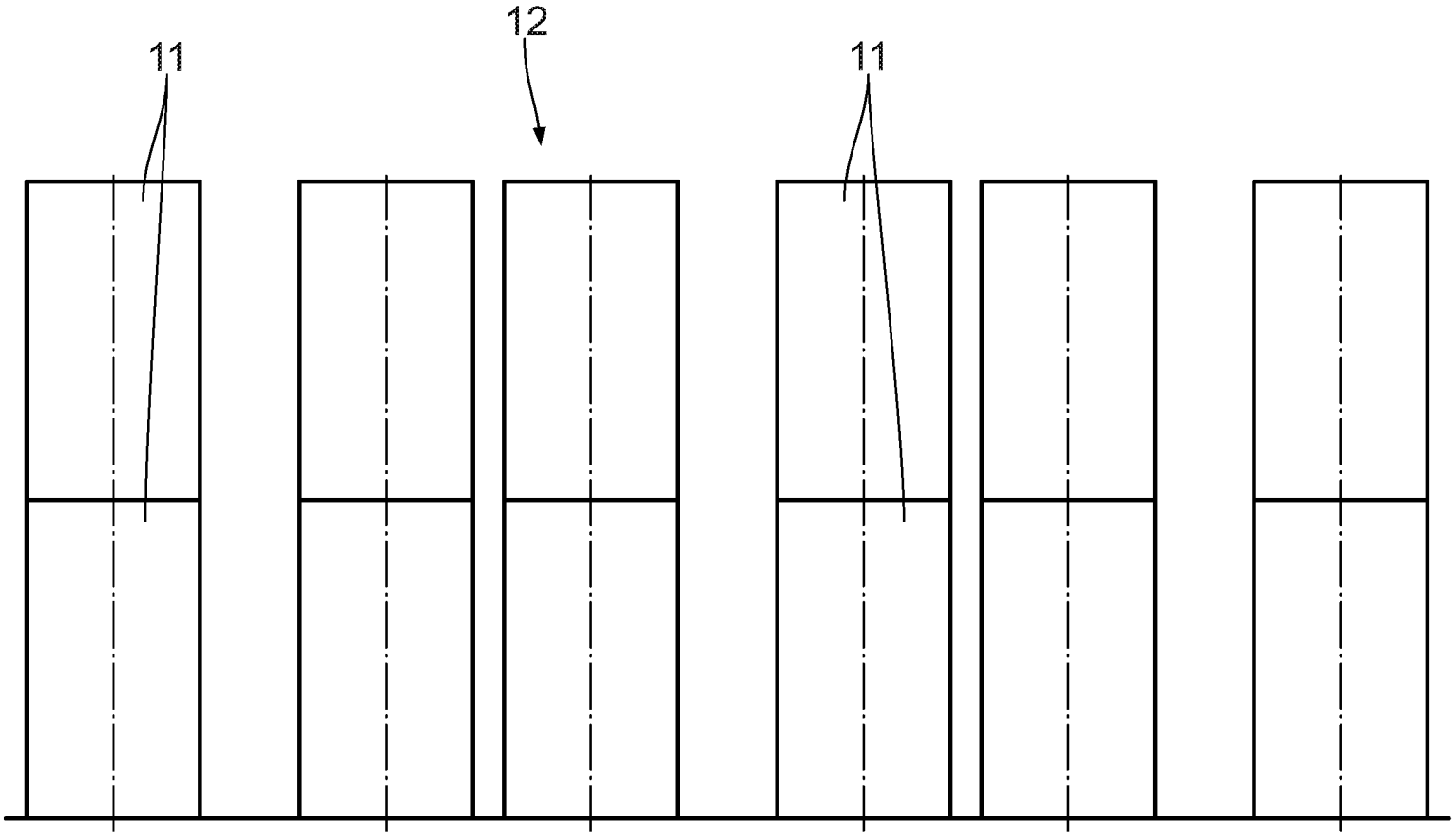
FIG. 10 shows a view showing a material roll store of the overall installation according to FIG. 1 from the front.

The frame 79 also bears a hydraulic unit 82 (FIG. 9). The hydraulic unit 82 is in turn in flow connection with a hydraulic tank borne by the frame 79, for supplying the hydraulic lifting device 81 with hydraulic fluid. It comprises a hydraulic pump and a hydraulic control device, which is in flow connection with the hydraulic pump and at least one lifting cylinder 83 of the hydraulic lifting device 81. Hydraulic oil is used in particular.

Arranged in the cab 80 are a driver seat 84*a* and also operating elements of the industrial truck 25 for a driver, if required.

The hydraulic unit 82 also serves with preference for operating a steering device of the industrial truck 25. In the cab 80 there is also a steering wheel 84*b* for actuating the steering device. The hydraulic control device is then also in flow connection with the steering device. It serves for controlling the hydraulic pump, in particular the at least one lifting cylinder 83 and the steering device. The steering device can be used for deflecting the rear wheels 78, in order that the industrial truck 25 can travel in a curved manner.

The industrial truck 25 also has an electrical industrial truck control unit 85, which is also in signalling connection with the hydraulic control device.

The hydraulic lifting device 81 comprises a vertically extending lifting mast 86, which is arranged at the front of the industrial truck 25 and has a gripping device 87 that can be displaced upwards and downwards on it for the secure gripping and lifting and also holding of a material roll 11.

Figure 14:
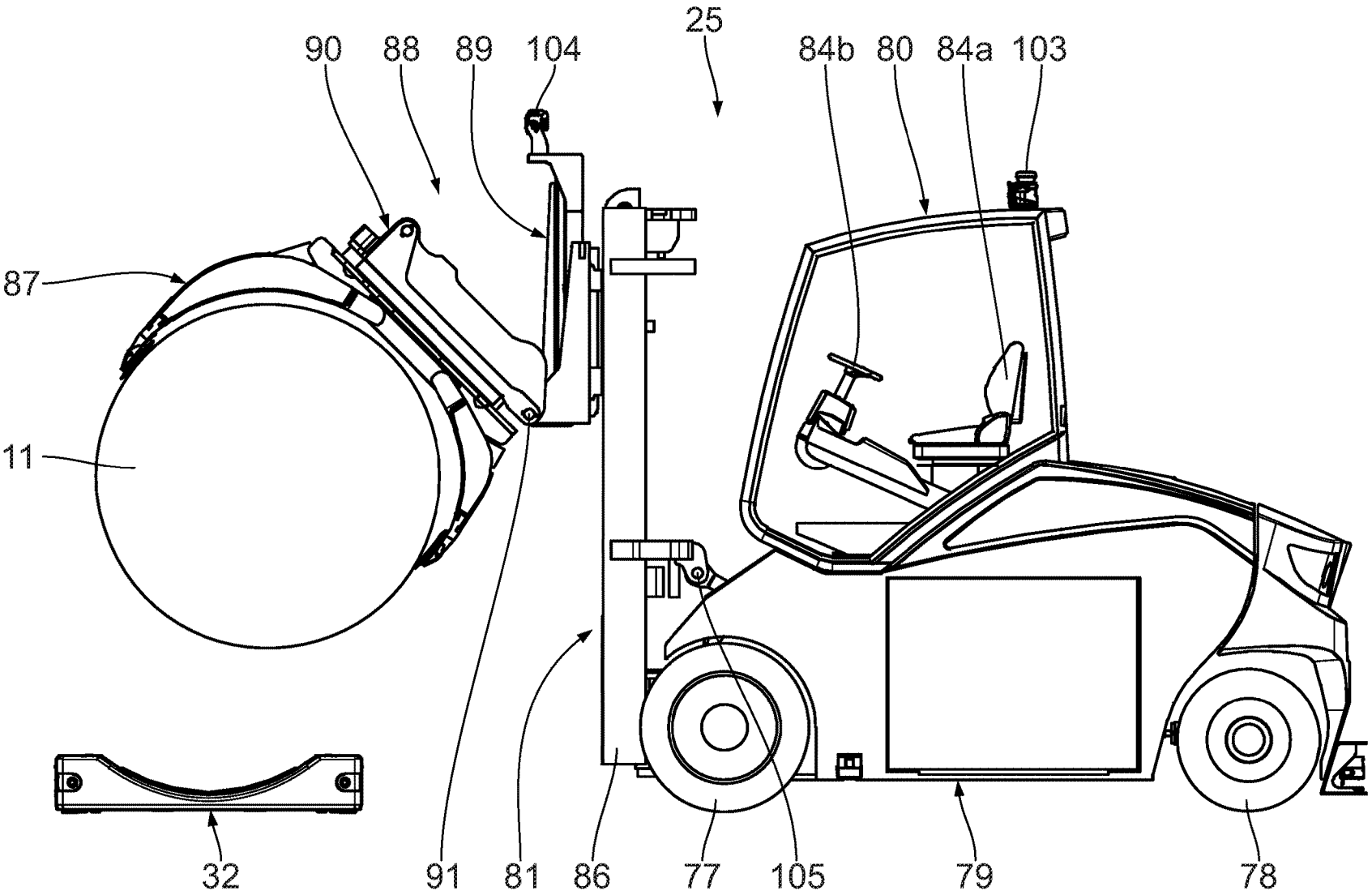
FIG. 14 shows a side view of the transfer system shown in FIG. 13.
Figure 15:
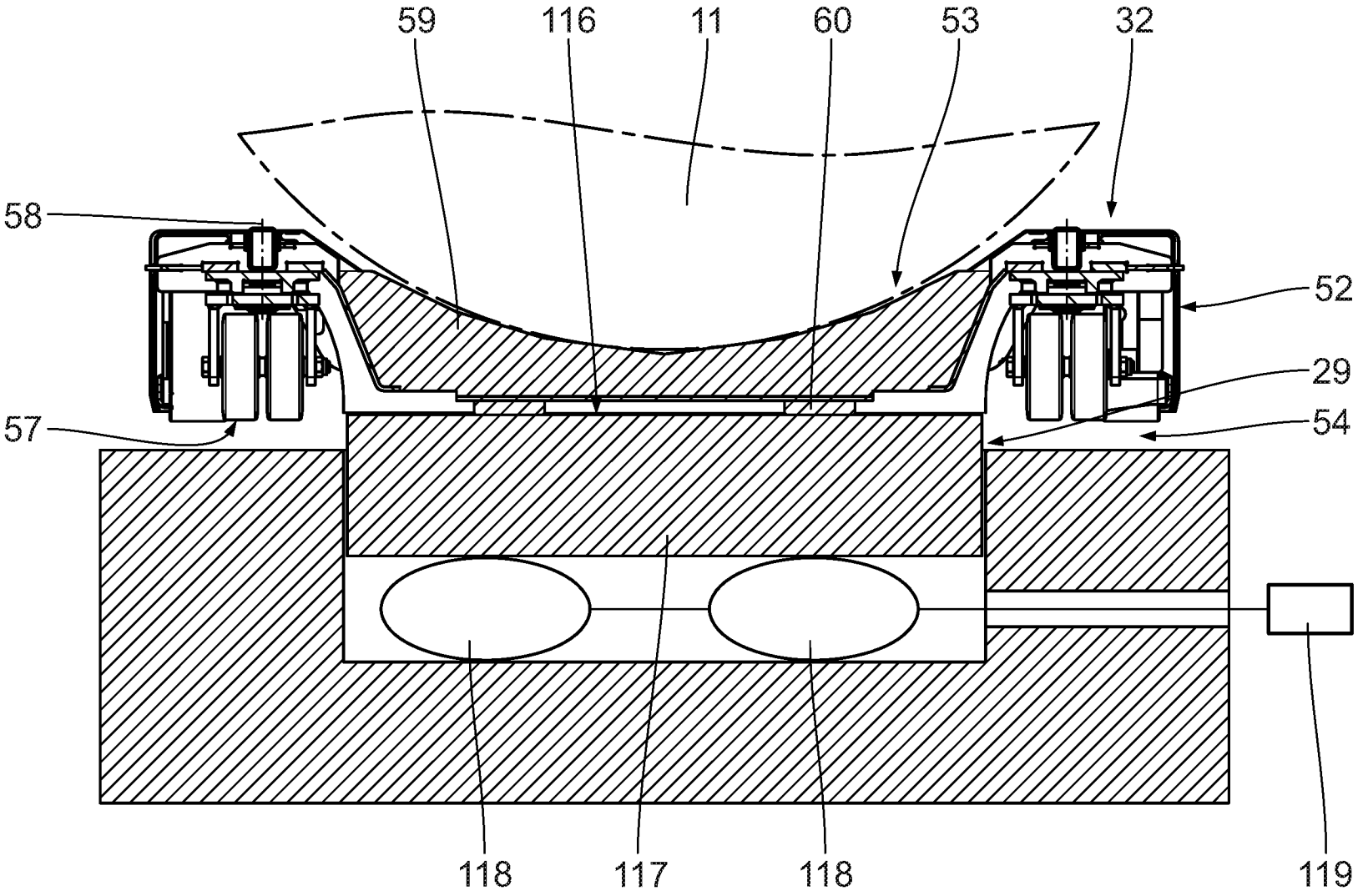
FIG. 15 shows a section through an active load-relieving device of the transfer system shown in FIGS. 13 and 14.

The gripping device 87 is arranged on the lifting mast 86 by way of a coupling device 88 shown for example in FIG. 14. The coupling device 88 comprises a connection device 89, connected to the lifting mast 86, and a carrying device 90, movably connected to said connection device. The connection device 89 is displaceable in a guided manner along the lifting mast 86. It is designed for example as a slide. The carrying device 90 is pivotable about a pivot axis 91 in relation to the connection device 89. Furthermore, the entire gripping device 87 is rotatable. It comprises a plate-like carrying body 92.

The carrying device 90 comprises a plate-like carrying body 92. Articulated on the carrying body 92 are a first gripping arm device 93 and a second gripping arm device 94. The gripping arm devices 93, 94 are articulated and arranged on the carrying body 92 at a distance from one another.

Figure 8A:
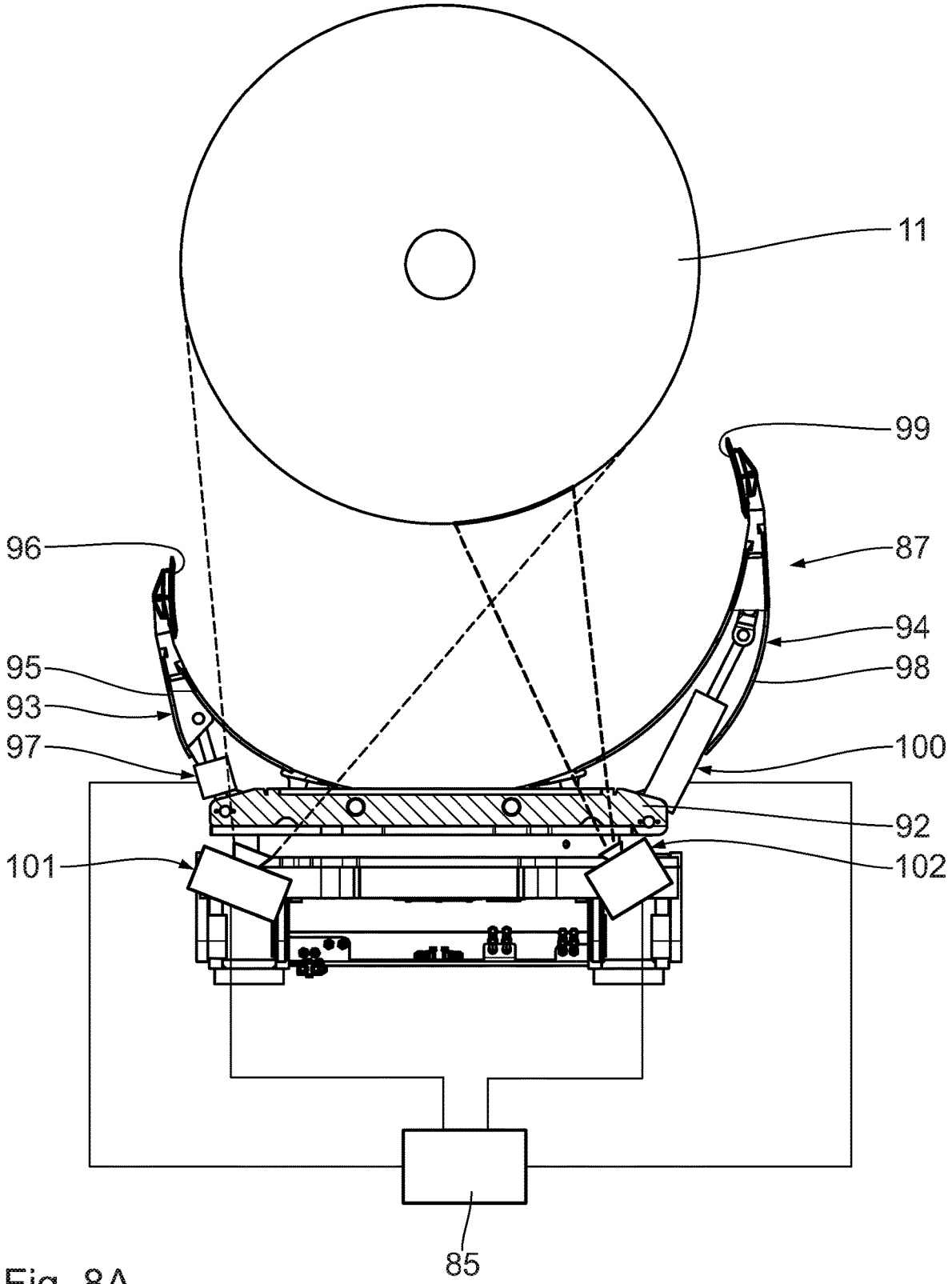
FIG. 8A shows a cross section through a gripping device of the transfer assembly illustrated in FIGS. 6 and 7, together with a material roll to be transferred and a material roll sensing device and also a controller.
Figure 8B:
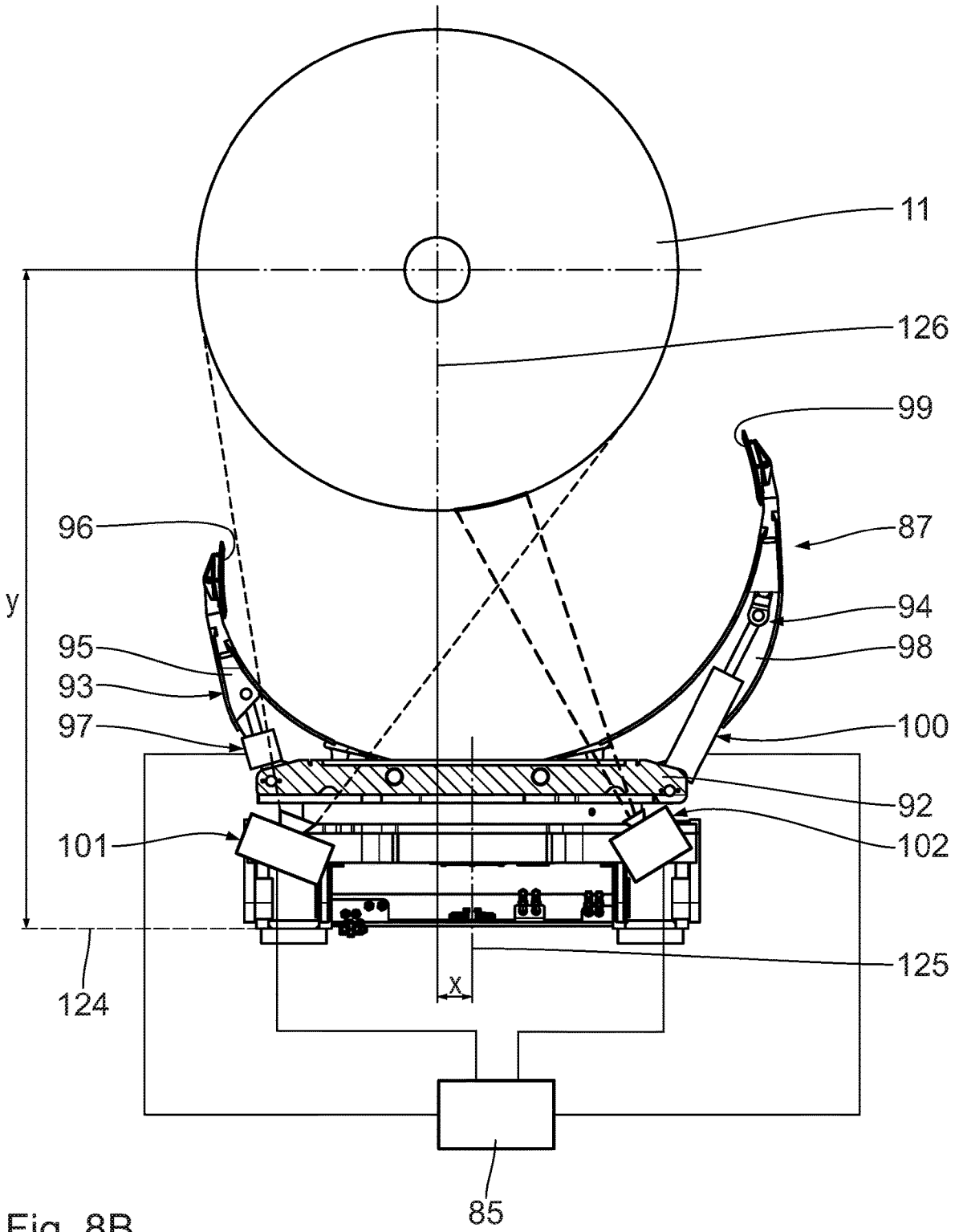
FIG. 8B-8D show views corresponding to FIG. 8A, which illustrate a positional calculation of the gripping device.

They have pivot axes running parallel to one another and are pivotable relatively in relation to one another (FIG. 8A).

The first gripping arm device 93 has a first gripping arm 95 and a first contacting jaw 96, which is arranged freely pivotably at a free end of the first gripping arm 95. The first gripping arm 95 is pivotable by way of a first, length-variable adjusting cylinder unit 97. The first adjusting cylinder unit 97 is arranged between the first gripping arm 95 and the carrying body 92 and is connected to them in an articulated manner.

The second gripping arm device 94 has a second gripping arm 98 and a second contacting jaw 99, which is arranged freely pivotably at a free end of the second gripping arm 98. The second gripping arm 98 is pivotable by way of a second, length-variable adjusting cylinder unit 100. The second adjusting cylinder unit 100 is arranged between the second gripping arm 98 and the carrying body 92 and is connected to them in an articulated manner.

The gripping arms 95, 98 are curved, thereby delimiting a substantially part-circular material roll receiving space. The contacting jaws 96, 99 are favourably of an identical construction. Their contacting surfaces are facing one another.

The second gripping arm 98 is much longer than the first gripping arm 95. It is preferably at least 30%, with preference at least 40%, with preference at least 50%, longer than the first gripping arm 95. It is at most 120%, with preference at most 100%, with preference at most 80%, longer than the first gripping arm 95. The gripping device 87 is asymmetrical, so that it can be used in a very confined space. The gripping arm devices 93, 94 have different lengths or sizes. The contacting surfaces of the contacting jaws 96, 99 normally have different distances from the carrying body 92.

Each adjusting cylinder unit 97, 100 is in connection with the hydraulic control device of the industrial truck 25 for actuating the same.

The coupling device 88 also bears a material roll sensing device, which comprises a first material roll sensing unit 101 and a second material roll sensing unit 102 (especially FIG. 8A-8D). The material roll sensing units 101, 102 are arranged laterally at a distance from one another. They are arranged adjacent to points of articulation of the adjusting cylinder units 97, 100 on the carrying body 92. The material roll sensing units 101, 102 are oriented in such a way that they are capable of sensing a material roll 11 to be transferred or to be gripped. They are directed forwards in relation to the industrial truck 25. They are also arranged obliquely in relation to one another. The material roll sensing units 101, 102 are arranged tilted towards one another, so that their sensing ranges overlap or cover one another.

Each material roll sensing unit 101, 102 is in signalling connection with the industrial truck control unit 85.

Arranged on the top of the cab 80 is a navigation sensor 103 for navigating the industrial truck 25. The navigation sensor 103 is in signalling connection with the industrial truck control unit 85.

The coupling device 88 bears an object detecting device 104, which is directed forwards in relation to the industrial truck 25. The object detecting device 104 is in signalling connection with the industrial truck control unit 85.

The lifting mast 86 is adjustable in its inclination at the bottom about a horizontally running axis of inclination 105. It is pivotable to the front and rear in relation to the cab 80.

Assigned to the lifting mast 86 is an inclination sensor 106, which is capable of sensing the current inclination of the lifting mast 86, and consequently also the current inclination of the gripping device 87. The inclination sensor 106 is arranged on the frame 79. The inclination sensor 106 is in signalling connection with the industrial truck control unit 85.

The hydraulic lifting device 81 comprises a hydraulic fluid pressure-change detecting device 107, which is arranged in a hydraulic line of the industrial truck 25 and is capable of detecting a pressure change of the hydraulic fluid of the hydraulic lifting device 81 when any changing of a load occurs (FIG. 9). The hydraulic fluid pressure-change detecting device 107 is in signalling connection with the industrial truck control unit 85.

The industrial truck 25 also has a number of safety laser scanning devices 108, which are in signalling connection with the industrial truck control unit 85 and are capable of stopping the industrial truck 25 immediately when danger is detected. A first safety laser scanning device 108 is arranged at the rear of the frame 79 and is directed to the rear in relation to the industrial truck 25. A second safety laser scanning device 108 is arranged at the bottom of the lifting mast 86 and is directed to the front in relation to the industrial truck 25. Also arranged on the frame 79 are third safety laser scanning devices 108, which are in each case directed laterally outwards. An industrial truck 25 equipped in such a way is used for example in the case of the delivery system 61 shown in FIG. 4. Such a delivery system 61 manages without any safety light barrier 74. The safety laser scanning devices 108 are in signalling connection with a central controller 123, which is in signalling connection with an operator terminal 76.

Each driving axle 109 of the industrial truck 25 is assigned a driving axle safety encoder 110, which is capable of delivering items of information with respect to angles and numbers of revolutions of the drive or of the corresponding driving axle 109. The driving axle safety encoder 25 is in signalling connection with the industrial truck control unit 85. The industrial truck 25 can thus be maneuvered particularly well.

A steering axle 111 of the industrial truck 25 is assigned a steering axle safety encoder 112, which is capable of delivering items of information concerning the position and angle of the steering axle 111. The steering axle safety encoder 112 is in signalling connection with the industrial truck control unit 85. The industrial truck 25 can thus be maneuvered particularly well.

The coupling device 88 is assigned a gripping arm angle encoder 113, which is capable of delivering items of information concerning the position and angle of the gripping arm devices 93, 94. Each gripping arm angle encoder 113 is in signalling connection with the industrial truck control unit 85. The gripping device 87 can thus be used particularly reliably and can be aligned particularly reliably in relation to the material roll 11 to be gripped.

The carrying device 90 also bears an inclination sensor 114, which is capable of sensing an inclination of the gripping device 87 in relation to the lifting mast 86. The inclination sensor 114 is in signalling connection with the industrial truck control unit 85. The gripping device 87 can thus be used particularly reliably and can be aligned particularly reliably in relation to the material roll 11 to be gripped.

Furthermore, the carrying device 90 bears an inclination sensor 115, in order to detect an inclination of the gripping device 87 in relation to a vertical. The inclination sensor 115 is in signalling connection with the industrial truck control unit 85. The gripping device 87 can thus be used particularly reliably and can be aligned particularly reliably in relation to the material roll 11 to be gripped.

Each transfer system 29 comprises in the respective transfer area 31 a transporting carriage load-relieving device 116 (FIG. 15), which comprises a rigid raising body 117 which can be displaced in height. When it is not in use, the raising body 117 is flush with the adjacent underlying surface. Each raising body 117 is displaceable in height in a guided manner by means of a cushion arrangement 118, which for this can be inflated with a gas, such as air, by means of an actuator 119. Each raising body 117 can be raised for example by at least 1 cm, with preference at least 3 cm, with preference at least 5 cm. It can preferably be raised by at most 20 cm, with preference at most 15 cm, with preference at most 10 cm. For lowering the raising body 117, the gas can be let out of the cushion arrangement 118 again in a controlled manner by means of the associated actuator 119. Instead of a cushion arrangement 118, a spindle or a hydraulic system can be used for example.

Each raising body 117 is for example like a plate or like a block and has a rectangular upper engaging surface. Each engaging surface has a first dimension, which corresponds approximately to a transverse dimension of the at least one channel part 59. It is less than the transverse dimension of an entire transporting carriage 32. A second dimension of the engaging surface, perpendicular to the first dimension, corresponds for example to a longitudinal dimension of the at least one channel part 59.

Each transfer system 29 also comprises two material roll orientation sensing sensors 120, which are capable of sensing the orientation of a transferred material roll 11 in the respective transfer area 31 or adjacent to it. The material roll orientation sensing sensors 120 are arranged next to one another a lateral distance apart, with preference at a common height. During use, they sense axial end regions of the material roll 11. In particular, an inclined position of the material roll 11, especially in the horizontal, can thus be sensed. Each material roll orientation sensing sensor 120 is in signalling connection with a computing unit 121, which in turn is in signalling connection with the transporting carriage 32 in the respective transfer area 31 for aligning the same on the basis of this material roll 11, insofar as this is necessary.

Each transfer area 31 is protected by a protective fence 122, which extends along the material roll orientation sensing sensors 120. If danger is detected, the transfer is stopped immediately.

The operation of the overall installation is described in more detail below.

When the semitrailer unit 62 has been brought into its intended stopping position by a driver and clearance for unloading the semitrailer unit 62 has been given by the driver or some other person using the operator terminal 76 after corresponding removal of the tarpaulin 68, an industrial truck 25 independently begins unloading the material rolls 11 from the loading space 69. The unloading of the semitrailer unit 62 is favourably performed laterally from the outside. The industrial truck 25 is capable of operating in a driverless or completely automatic manner (FIGS. 1 to 5). It has been correspondingly activated by way of its communication device.

The object detecting device 104 of the industrial truck 25 is capable of detecting the semitrailer unit 62. In particular, the object detecting device 104 is capable of detecting the loading area 66, the material rolls 11 and the tarpaulin frame 67, as well the tarpaulin 68 if present.

The material roll sensing units 101, 102 are capable of sensing different circumferential portions of the material roll 11 to be gripped. The sensed circumferential portions are located at a common height. The first sensing range of the first material roll sensing unit 101 is much greater than the second sensing range of the second material roll sensing unit 102. It preferably senses a first circumferential portion of the material roll 11, which includes an angular angle of between 100° and 150°. The second sensing range of the second material roll sensing unit 102 senses with preference a second circumferential portion of the material roll 11, which includes an angular angle of between 10° and 50°. The second sensing range lies completely within the first sensing range.

The first material roll sensing unit 101 is capable in particular of sensing the actual diameter of the material roll 11 to be gripped. The second material roll sensing unit 102 is capable in particular of sensing or reading an identification label arranged circumferentially on the material roll 11, which with preference contains a barcode and serves for the unique identification of the material roll 11 to be gripped.

By way of the unique identification of the material roll 11 by means of the second material roll sensing unit 102, the first material roll sensing unit 101 compares the actually sensed diameter of the material roll 11 with a known diameter value from a database and/or the diameter value specified on the identification label.

Figure 5:
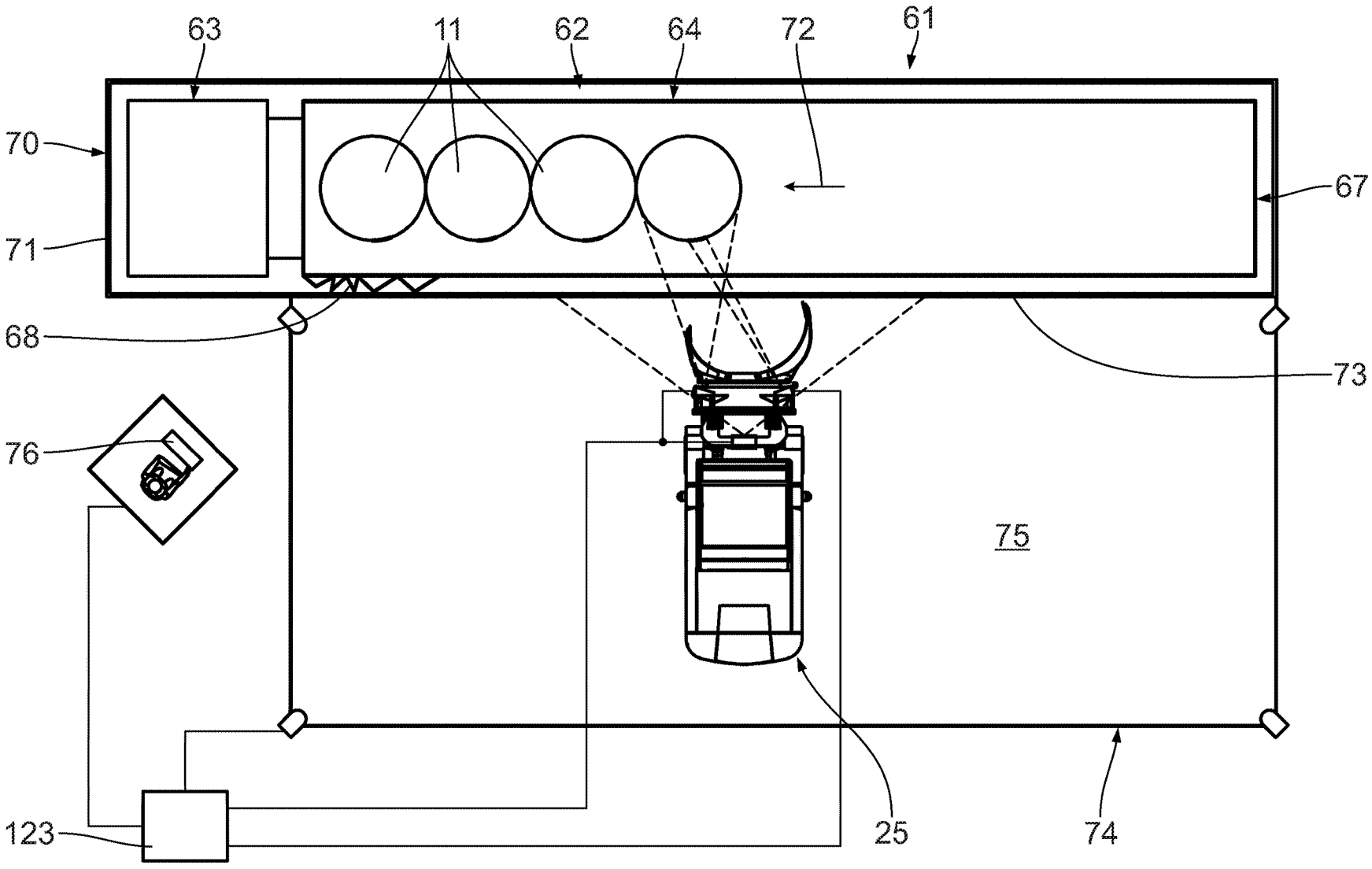
FIG. 5 shows a plan view similar to FIG. 4 of the delivery system shown in FIGS. 2 and 3, in which a material roll/object detecting device of the transfer assembly is shown in the active state.
Figure 6:
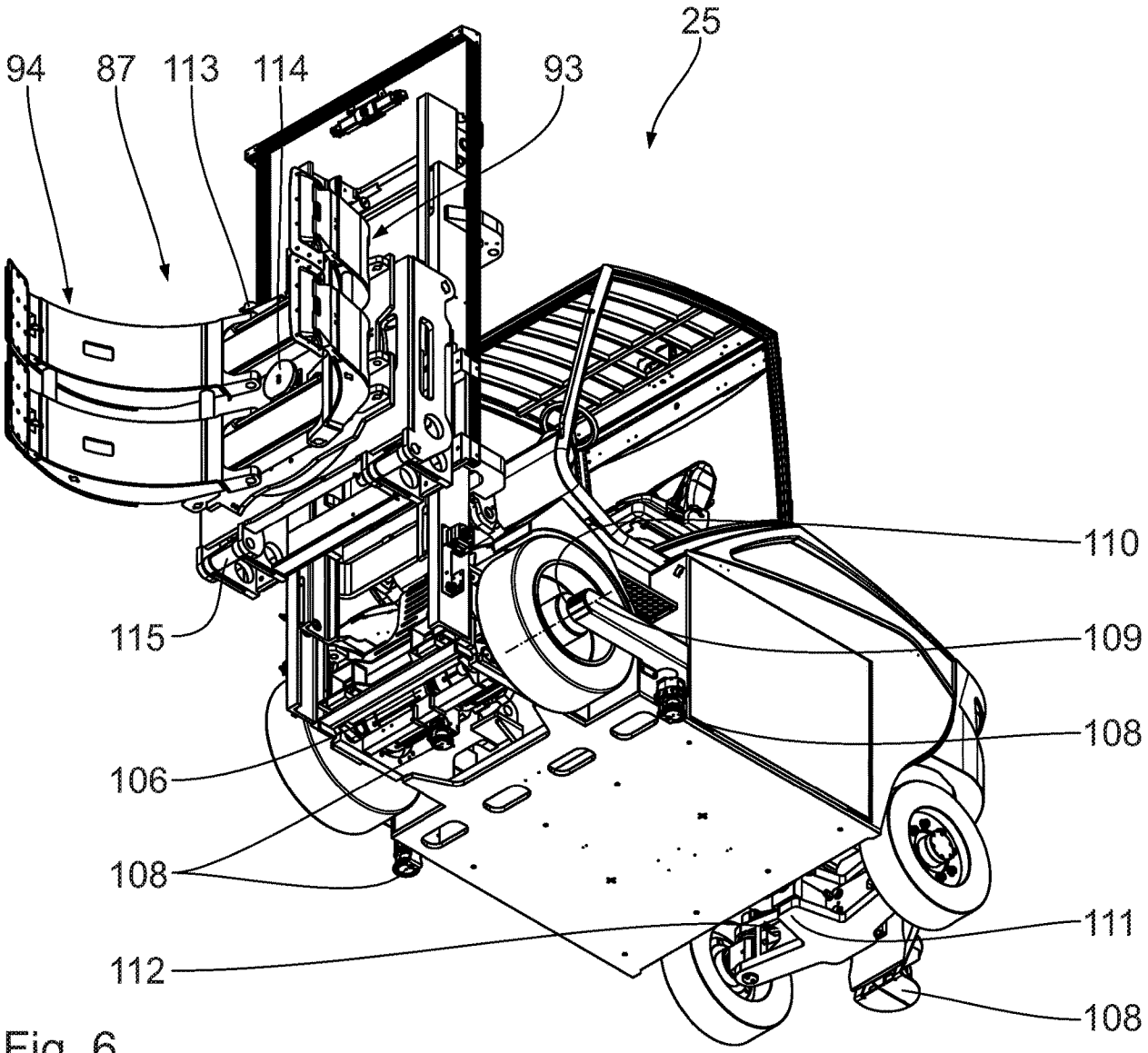
FIG. 6 shows a detailed perspective view of a transfer assembly obliquely from below.
Figure 7:
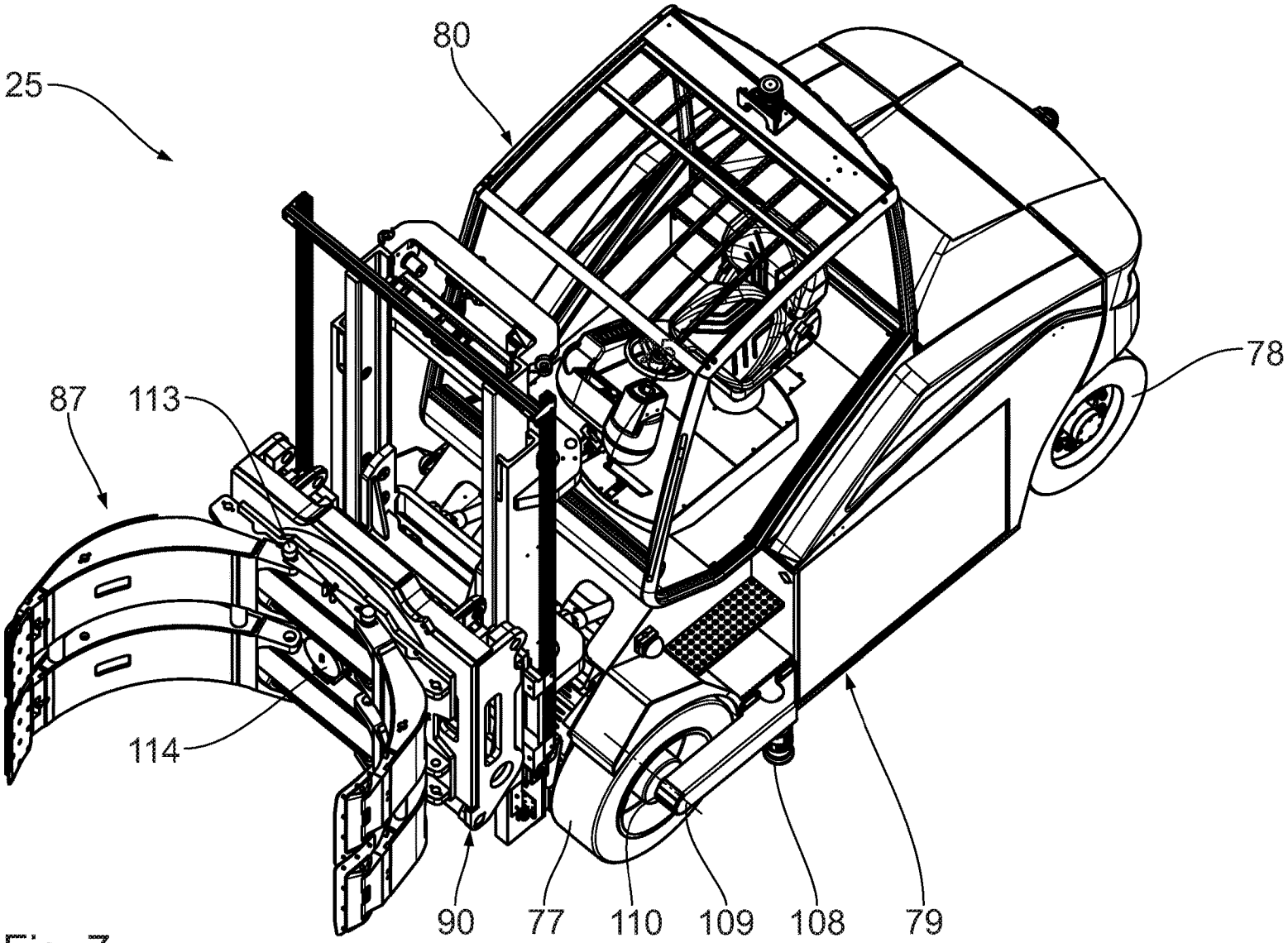
FIG. 7 shows a detailed perspective view of the transfer assembly shown in FIG. 6 obliquely from above.

In the case of the embodiment according to FIG. 2, 3, 5, the delivery safety device 74 is active. Alternatively or in addition, the safety laser scanning devices 108 are active (FIG. 5). They are capable of stopping the industrial truck 25 immediately when danger is detected.

For gripping a material roll 11 to be gripped, first, with the gripping device 87 open, the first gripping arm device 93 is brought by its first contacting jaw 96 into contact circumferentially with the material roll 11 to be gripped. The first gripping arm device 93 is in this case in a predetermined position in dependence on the diameter of the material roll 11 to be gripped. In the case of material rolls 11 with a large diameter (for example ≥150 cm), the first gripping arm device 93 assumes an outer or wide position. In the case of material rolls 11 with a smaller diameter (for example <150 cm), the first gripping arm device 93 assumes an inner or narrow position. The first contacting jaw 96 then lies circumferentially against the material roll 11 to be gripped. This takes place by appropriately displacing and steering the industrial truck 25. The gripping device 87 has been moved to an appropriate height along the lifting mast 86.

When the upright material roll 11 to be gripped is then in the gripping device 87, for the actual gripping, the second gripping arm device 94 is pivoted in the direction of the fixed first gripping arm device 93 by means of actuating the second adjusting cylinder unit 100, so that the gripping device 87 is closed. The second gripping arm device 94 then comes into contact by its second contacting jaw 99 with the material roll 11 to be gripped, while reducing the material roll receiving space. The material roll 11 is held by the gripping device 87 in a clamping manner. A contacting axis running through the contacting jaws 96, 99 runs obliquely in relation to a longitudinal axis of the industrial truck 25 in the horizontal. The gripping arm devices 93, 94 are in this case located with preference in a common, substantially horizontal plane. The lifting mast 86 is uninclined in relation to a vertical.

The activation of the gripping device 87, of the displacement drive and/or of the steering of the transfer assembly 25 is performed in dependence on the respective diameter of the material roll 11 to be gripped. The diameter of the material roll 11 to be gripped can be determined for example by way of the first material roll sensing sensor 101 or by way of the label arranged on this material roll 11, by means of the second material roll sensing sensor 102. In dependence on the fixed or pre-positioned position of the first gripping arm device 93 and the diameter of the material roll 11 to be gripped, a theoretical intended central axis of the material roll 11 to be gripped is obtained. The intended central axis is compared with the actual central axis of the real material roll 11 to be gripped by means of the first and second material roll sensing units 101, 102. The central axis of the intended position shifts due to the asymmetry of the gripping device 87 and the asymmetry in the activation of the gripping arm devices 93, 94. In dependence on these values, in particular the second gripping arm device 93 or 94, the displacement drive and/or the steering of the transfer assembly 25 are actuated in such a way that they reliably grip the material roll 11 and engage the material roll 11 substantially in opposite circumferential regions of the material roll 11.

Figure 8C:
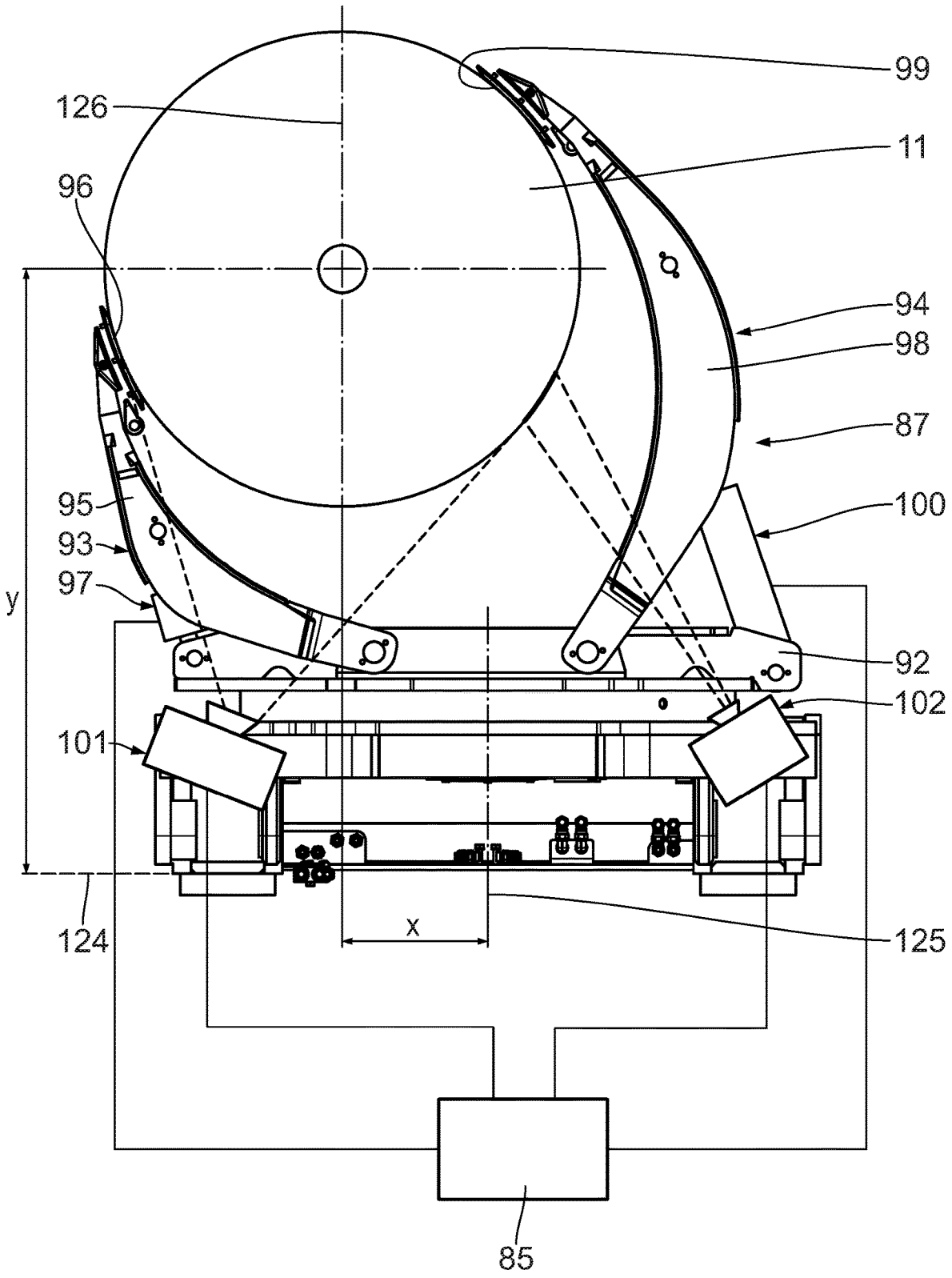
Figure 8D:
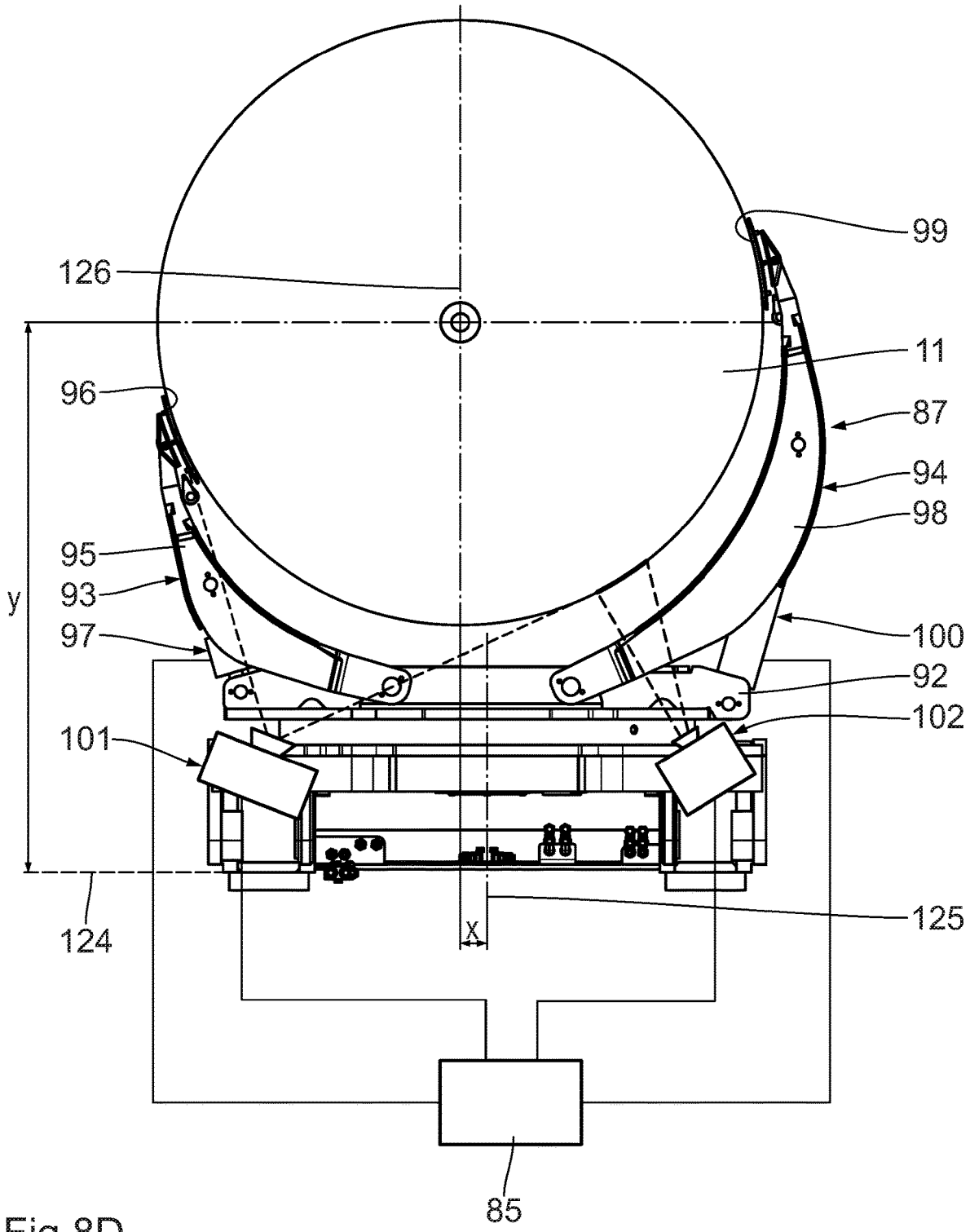

In dependence on a diameter of the material roll 11, the central axis of the material roll 11 shifts in relation to a zero point or the central plane 125 of the gripping device 87. The central axis of the material roll 11 in this case shifts on a curve or function, which should be correspondingly taken into account when approaching the material roll 11. As FIG. 8C shows, in the case of a gripped material roll 11 that has a small diameter, the lateral horizontal offset between the central plane 125 of the gripping device 87 and the central plane 126 of the material roll 11 that includes the central axis of the material roll 11 is comparatively great (x value). As FIG. 8D shows, in the case of a gripped material roll 11 that has a great diameter, the lateral horizontal offset between the central plane 125 of the gripping device 87 and the central plane 126 of the material roll 11 that includes the central axis of the material roll 11 is comparatively small (x value). The greater the diameter of the gripped material roll 11, the smaller the lateral horizontal offset between the central plane 125 of the gripping device 87 and the central plane 126 of the material roll 11 that includes the central axis of the material roll 11. When gripping the material roll 11, the first gripping arm 95 has a substantially identical fixed or pre-positioned position or deflection. The smaller the diameter of the gripped material roll 11, the further the second gripping arm 98 is pivoted in the direction of the first gripping arm 95 or the central plane 125 of the gripping device 87. The smaller the diameter of the gripped material roll 11, the further the gripped material roll 11 is kept away from the reference plane 124 or from the points of articulation of the gripping arms 95, 98 on the carrying body 92.

During the raising of the material roll 11, the hydraulic fluid pressure-change detecting device 107 detects a change in pressure of the hydraulic fluid of the hydraulic lifting device 81. When a high point of an increase in a pressure of the hydraulic fluid is reached, the hydraulic fluid pressure-change detecting device 107 detects a completely raised state of the material roll 11. The material roll 11 has then been lifted completely off the loading area 66. The hydraulic lifting device 81 then raises the material roll 11 a further 20 mm, in order to ensure reliable unloading and, if appropriate, lifting over fittings, end features, tensioning belts, a loading sill or the like of the semitrailer unit 62, but prevent damage to a roof of the semi-trailer unit 62. For this purpose, it has been appropriately activated by the industrial truck control unit 85.

For removing the material rolls 11, the industrial truck 25 reverses and thereby moves away from the semitrailer unit 62.

The industrial truck 25 then brings the gripped material roll 11 into the material roll store 10 in an upright position. To do so, it travels over the transfer assembly main path 27 to the transfer assembly circulating path 26 and then to the respective group 12. The industrial truck 25 places the material roll 11 at the predetermined location in an upright position. The object detecting device 104 supports the placement at the predetermined location. During placement, the gripping device 87 is lowered together with the material roll 11. The hydraulic fluid pressure-change detecting device 107 also detects when the material roll 11 has been placed. The material rolls 11 stay in the material roll store 10 until they are required.

A higher-level control initiates the retrieval of a material roll 11 to be used from the material roll store 10 for the production of corrugated board in the corrugator 1. Material rolls 11 required for the operation of the corrugator 1 are fetched from the material roll store 10 by the industrial trucks 25. They are fed by way of the transfer assembly main path 27 to the first transfer system 29 or by way of the transfer assembly main path 27 and the transfer assembly transverse path 28 to the second transfer system 29.

At the respective transfer area 31, a transfer of the material roll 11 is performed from the industrial truck 25 onto a transporting carriage 32 that has been provided. When doing so, on the one hand the gripping device 87 is turned out of its previous position by 90°, so that the gripped material roll 11 assumes a lying, horizontal position. Furthermore, the carrying device 90 is pivoted out about the pivot axis 91. The gripping device 87 is then lowered and opened.

Before placing the material roll 11 into the material roll receptacle 53, the cushion arrangement 118 is inflated by way of the actuator 119, which leads to a raising or vertical displacement of the raising body 117. The raising body 117 then engages the at least one supporting plate 60 or the at least one channel part 59 from below, whereby the transporting carriage 32 is relieved of loading and all of the wheel units 54 are lifted off the underlying surface. The wheel units 54 are then suspended. An introduction of load takes place directly into the raised raising body 117. The cushion arrangement 118 is able to yield a little, in order to ease the load on the rigid transporting carriage 32.

The material roll 11 arranged in the material roll receptacle 53 lies on the material roll detecting sensor, which thus detects loading with the material roll 11. It extends horizontally. The material roll 11 lies on the at least one channel part 59. Over a partial circumferential region of the material roll 11, the at least one channel part 59 lies against the latter at the bottom and/or laterally.

After lowering of the raising body 117 by the actuator 119, the transporting carriage 32 then travels, if necessary, to the adjacent material roll preparation arrangement 147, where the delivered material roll 11 is received and prepared.

After completion of the preparation, the prepared material roll 11 then travels with a/the transporting carriage 32 to a corresponding unrolling unit that requires this material roll 11. Alternatively, the bypass is used and the material roll preparation assembly 147 is bypassed.

The central control device subsequently sends the laden transporting carriage 32 to the splicing device 3, 4, 6, 7, 8 that requires the material roll 11.

The transporting carriage 32 then travels over the corresponding path to the splicing device 3, 4, 6, 7, 8.

Each industrial truck 25 can also be controlled manually. In the overall installation, a number of industrial trucks 25 and transporting carriages 32 are used.

Switching over between manual steering and automatic steering or automatic activation of steering cylinders of the industrial truck 25 is favourably possible. A changeover to manual operation is preferably performed when there are critical or difficult situations in the handling of the material roll 11 to be transferred.

Signal connections may be designed for example as wireless or wirebound. With the signal connections, signals can be transferred or transmitted.

The overall installation can be operated in a quasi completely automated manner.

According to an alternative embodiment, corrugated board that differs in its number of plies from the corrugated board described is produced. The corrugator 1 used for this purpose is modified appropriately.

Individual aspects or subject matter may be part of an independent invention.

What is claimed is:

1. A transfer system for transferring an item, the transfer system comprising:

a transfer assembly for transferring an item to a transporting carriage in a transfer area; and a transporting carriage for receiving the item from the transfer assembly in the transfer area;

a transporting carriage load-relieving device, which is arranged in the transfer area and is configured to relieve the transporting carriage upon receiving the item to be transferred, wherein the transporting carriage load-relieving device comprises a raising device for raising the transporting carriage upon receiving the item to be transferred; and an aligning assembly for aligning the transporting carriage to the item transferred from the transfer assembly into the transfer area, wherein the aligning arrangement comprises an item orientation sensing device for sensing an orientation of the item transferred from the transfer assembly into the transfer area.

2. The transfer system according to claim 1, which serves for transferring a material roll.

3. The transfer system according to claim 1, wherein, when the raising device is being used, the raising device engages an item receptacle of the transporting carriage.

4. The transfer system according to claim 1, wherein the raising device engages the transporting carriage spaced from a base frame of the transporting carriage.

5. The transfer system according to claim 1, wherein the raising device has a compensation spring unit to compensate for a peak load.

6. The transfer system according to claim 1, further comprising a computing unit, which is in signalling connection with the item orientation sensing device and is intended for receiving items orientation information characteristic for the orientation of the item from the item orientation sensing device.

7. The transfer system according to claim 6, wherein the computing unit is in signalling connection with the transporting carriage for aligning the transporting carriage in dependence on the items orientation information.

8. The transfer system according to claim 1, further comprising a transfer station for axial alignment of the item transferred from the transfer assembly to the transporting carriage.

9. The transfer system according to claim 1, further comprising at least one protective element at least partially delimiting the transfer area.

10. An overall installation, comprising:

at least one transfer system for transferring an item, the at least one transfer system comprising a transfer assembly for transferring an item to a transporting carriage in a transfer area, the at least one transfer system further comprising a transporting carriage for receiving the item from the transfer assembly into the transfer area, the at least one transfer system further comprising a transporting carriage load-relieving device, which is arranged in the transfer area and is configured to relieve the transporting carriage upon receiving the item to be transferred, wherein the transporting carriage load-relieving device comprises a raising device for raising the transporting carriage upon receiving the item to be transferred, wherein the transfer area comprises a support structure, the raising device being movable such that the raising device moves relative to the support structure, the transporting carriage comprising a wheel steering unit, the raising device being configured to lift the transporting carriage such that the wheel steering unit is located at a spaced location from the support structure when the raising device is in a raised position; and a corrugator plant.

11. An item transfer method for transferring an item, the method comprising the steps of:

transferring an item to a transporting carriage in a transfer area from a transfer assembly; and receiving the item transported by the transfer assembly in the transfer area by the transporting carriage, wherein a transporting carriage load-relieving device is arranged in the transfer area, the transporting carriage load-relieving device being configured to relieve the transporting carriage upon receiving the item to be transferred, wherein the transporting carriage load-relieving device comprises a raising device for raising the transporting carriage upon receiving the item to be transferred, wherein the transfer area comprises a support structure, the raising device being movable such that the raising device moves relative to the support structure, the transporting carriage comprising a wheel steering unit, the raising device being configured to lift the transporting carriage such that the wheel steering unit is located at a spaced location from the support structure when the raising device is in a raised position.

12. The item transfer method according to claim 11, wherein the item is a material roll.

13. The overall installation according to claim 10, wherein the item is a material roll.

14. The transfer system according to claim 1, wherein the transfer area comprises a support structure, the raising device being movable such that the raising device moves relative to the support structure, the transporting carriage comprising a wheel steering unit, the raising device being configured to lift the transporting carriage such that the wheel steering unit is located at a spaced location from the support structure when the raising device is in a raised position.

15. A transfer system for transferring an item, the transfer system comprising:

a transfer assembly for transferring an item to a transporting carriage in a transfer area; and a transporting carriage for receiving the item from the transfer assembly in the transfer area;

a support structure;

a transporting carriage load-relieving device, which is arranged in the transfer area and is configured to relieve the transporting carriage upon receiving the item to be transferred, wherein the transporting carriage load-relieving device comprises a raising device configured to raise each and every portion of the transporting carriage, relative to the support structure, to a spaced location from the support structure upon receiving the item to be transferred, the transport carriage being in contact with the support structure when the raising device is in a non-raised position.

16. The transfer system according to claim 15, wherein the support structure comprises a recess, at least a portion of the raising device is arranged in the recess.

* * * * *